US012252770B2

(12) United States Patent
Ferrasse et al.

(10) Patent No.: US 12,252,770 B2
(45) Date of Patent: Mar. 18, 2025

(54) ECAE PROCESSING FOR HIGH STRENGTH AND HIGH HARDNESS ALUMINUM ALLOYS

(71) Applicant: Honeywell International Inc., Charlotte, NC (US)

(72) Inventors: Stephane Ferrasse, Spokane, WA (US); Frank C. Alford, Spokane Valley, WA (US); Susan D. Strothers, Mead, WA (US); Patrick Underwood, Spokane, WA (US)

(73) Assignee: Honeywell International Inc, Charlotte, NC (US)

( * ) Notice: Subject to any disclaimer, the term of this patent is extended or adjusted under 35 U.S.C. 154(b) by 12 days.

(21) Appl. No.: 18/131,075

(22) Filed: Apr. 5, 2023

(65) Prior Publication Data

US 2023/0243027 A1 Aug. 3, 2023

Related U.S. Application Data

(62) Division of application No. 16/580,905, filed on Sep. 24, 2019.

(Continued)

(51) Int. Cl.
*C22F 1/047* (2006.01)
*B21C 23/00* (2006.01)

(Continued)

(52) U.S. Cl.
CPC ..... *C22F 1/047* (2013.01); *B21C 23/002* (2013.01); *C22C 21/08* (2013.01)

(58) Field of Classification Search
CPC ..... C22F 1/047; C22F 1/043; B21C 23/002; B21C 23/001; C22C 21/08
See application file for complete search history.

(56) References Cited

U.S. PATENT DOCUMENTS 4,770,484 A 9/1988 Mori
4,770,848 A 9/1988 Ghosh et al.

(Continued)

FOREIGN PATENT DOCUMENTS

CN 1459512 A 12/2003
CN 1918311 A 2/2007

(Continued)

OTHER PUBLICATIONS

"A Critical Evaluation of the Processing and Properties of Ultrafine-Grained Materials Produced by Intense Plastic Straining." National Science Foundation, Award Abstract #9625969, Investigator Terrence Langdon, Last amendment date is Jan. 8, 1998, 2 pages.

(Continued)

*Primary Examiner* — Anthony M Liang
*Assistant Examiner* — Danny N Kang
(74) *Attorney, Agent, or Firm* — Faegre Drinker Biddle & Reath LLP

(57) ABSTRACT

A high strength aluminum alloy material comprises aluminum as a primary component and at least one of magnesium and silicon as a secondary component at a concentration of at least 0.2% by weight. The material has a Brinell hardness of at least 90 BHN, a yield strength of at least 250 MPa, an ultimate tensile strength of at least 275 MPa, and a percent elongation of at least 11.5%.

10 Claims, 14 Drawing Sheets

Related U.S. Application Data

(60) Provisional application No. 62/750,469, filed on Oct. 25, 2018.

(51) Int. Cl.
*B21C 23/02* (2006.01)
*C22C 21/08* (2006.01)

(56) References Cited

U.S. PATENT DOCUMENTS

| | | | |
|---|---|---|---|
| 5,513,512 | A | 5/1996 | Segal |
| 5,620,537 | A | 4/1997 | Bampton |
| 5,826,456 | A | 10/1998 | Kawazoe et al. |
| 6,364,969 | B1 | 4/2002 | Couper |
| 7,017,382 | B2 | 3/2006 | Segal et al. |
| 7,296,453 | B1 | 11/2007 | Oruganti et al. |
| 7,971,464 | B2 | 7/2011 | Hachino et al. |
| 8,028,558 | B2 | 10/2011 | Segal |
| 8,137,755 | B2 | 3/2012 | Keener et al. |
| 8,535,505 | B2 | 9/2013 | Yi et al. |
| 9,265,169 | B2 | 2/2016 | Zhou et al. |
| 11,421,311 | B2 | 8/2022 | Ferrasse et al. |
| 11,649,535 | B2 | 5/2023 | Ferrasse et al. |
| 2002/0017344 | A1 | 2/2002 | Gupta et al. |
| 2005/0094280 | A1 | 5/2005 | Ahn et al. |
| 2006/0237134 | A1 | 10/2006 | Keener et al. |
| 2007/0084527 | A1 | 4/2007 | Ferrasse et al. |
| 2007/0169861 | A1 | 7/2007 | Bischofberger |
| 2008/0196801 | A1 | 8/2008 | Zhao et al. |
| 2009/0020192 | A1 | 1/2009 | Segal et al. |
| 2010/0031982 | A1 | 2/2010 | Hornsby et al. |
| 2010/0319820 | A1 | 12/2010 | Koma |
| 2012/0085470 | A1 | 4/2012 | Segal |
| 2013/0216852 | A1 | 8/2013 | Hsu et al. |
| 2014/0190739 | A1 | 7/2014 | Zhou et al. |
| 2014/0248177 | A1 | 9/2014 | Kamat et al. |
| 2014/0261909 | A1 | 9/2014 | Shih et al. |
| 2015/0090373 | A1 | 4/2015 | Gable et al. |
| 2015/0329949 | A1 | 11/2015 | Xing et al. |
| 2015/0354045 | A1 | 12/2015 | Gable et al. |
| 2016/0002805 | A1 | 1/2016 | Browning et al. |
| 2016/0115575 | A1 | 4/2016 | Bull et al. |
| 2016/0221318 | A1 | 8/2016 | Ramsden |
| 2016/0237530 | A1 | 8/2016 | Roy et al. |
| 2016/0355917 | A1 | 12/2016 | Kawamura et al. |
| 2017/0023706 | A1 | 1/2017 | Yang et al. |
| 2017/0101705 | A1 | 4/2017 | Mohanty et al. |
| 2018/0155811 | A1* | 6/2018 | Ferrasse ..... C22F 1/047 |
| 2018/0155812 | A1 | 6/2018 | Ferrasse et al. |
| 2018/0202039 | A1 | 7/2018 | Ferrasse et al. |
| 2020/0131611 | A1 | 4/2020 | Ferrasse et al. |
| 2020/0270730 | A1 | 8/2020 | Ferrasse et al. |
| 2021/0054490 | A1 | 2/2021 | Ferrasse et al. |

FOREIGN PATENT DOCUMENTS

| | | | |
|---|---|---|---|
| CN | 101654727 | A | 2/2010 |
| CN | 101690957 | B | 3/2012 |
| CN | 102925827 | A | 2/2013 |
| CN | 103060730 | A | 4/2013 |
| CN | 103909690 | A | 7/2014 |
| CN | 105331858 | A | 2/2016 |
| CN | 105339515 | A | 2/2016 |
| CN | 205556754 | U | 9/2016 |
| CN | 107502841 | A | 12/2017 |
| CN | 108468005 | A | 8/2018 |
| DE | 102008033027 | A1 | 3/2010 |
| EP | 2822717 | A1 | 1/2015 |
| GB | 0751125 | A | 6/1956 |
| JP | 09-137244 | A | 5/1997 |
| JP | 10-258334 | A | 9/1998 |
| JP | 11-114618 | A | 4/1999 |
| JP | 2000-271631 | A | 10/2000 |
| JP | 2000-271695 | A | 10/2000 |
| JP | 2004-176134 | A | 6/2004 |
| JP | 2004-176164 | A | 6/2004 |
| JP | 2008-196009 | A | 8/2008 |
| JP | 4753240 | B2 | 8/2011 |
| JP | 4920455 | B2 | 4/2012 |
| JP | 5202038 | B2 | 6/2013 |
| JP | 2015-218336 | A | 12/2015 |
| KR | 10-2005-0073316 | A | 7/2005 |
| KR | 10-0623662 | B1 | 7/2005 |
| KR | 2005-0073316 | A | 7/2005 |
| KR | 10-2005-0105825 | A | 11/2005 |
| KR | 2005-0105825 | A | 11/2005 |
| KR | 0623662 | B1 | 9/2006 |
| KR | 10-0778763 | B1 | 11/2007 |
| KR | 0778763 | B1 | 11/2007 |
| KR | 10-2009-0115471 | A | 11/2009 |
| KR | 10-2009-0118404 | A | 11/2009 |
| KR | 2009-0118404 | A | 11/2009 |
| KR | 10-2014-0041285 | A | 4/2014 |
| KR | 2014-0041285 | A | 4/2014 |
| KR | 10-2014-0118304 | A | 10/2014 |
| KR | 2014-0118304 | A | 10/2014 |
| KR | 10-2015-0001463 | A | 1/2015 |
| KR | 2015-0001463 | A | 1/2015 |
| RU | 2235799 | C1 | 9/2004 |
| RU | 2396368 | C2 | 8/2010 |
| RU | 2468114 | C1 | 11/2012 |
| RU | 2571993 | C1 | 12/2015 |
| TW | 440609 | B | 6/2001 |
| TW | 200408716 | A | 6/2004 |
| TW | 200540956 | A | 12/2005 |
| TW | 201435092 | A | 9/2014 |
| WO | 01/44536 | A2 | 6/2001 |
| WO | 2005/094280 | A2 | 10/2005 |
| WO | 2010/087074 | A1 | 8/2010 |
| WO | 2013/133976 | A1 | 9/2013 |
| WO | 2014/010678 | A1 | 1/2014 |
| WO | 2016/092135 | A1 | 6/2016 |
| WO | 2017/014990 | A1 | 1/2017 |
| WO | 2017/106665 | A1 | 6/2017 |
| WO | 2017/108986 | A1 | 6/2017 |
| WO | 2018/080710 | A1 | 5/2018 |
| WO | 2018/102328 | A1 | 6/2018 |

OTHER PUBLICATIONS

"IK500 High-Strength Die Casting Aluminum Alloy," Brochure. Interplex Quantum Co., Ltd., 2 pages, Available at least as early as Aug. 1, 2016.

BBS, "Hardness Conversion Table—Tensile Strength, Vickers, Brinell Och Rockwell," Jun. 11, 2021.

Birol, Y. (2004). The effect of homogenization practice on the microstructure of AA6063 billets. Journal of Materials Processing Technology, 148:250-258.

Duan, Zhi Chao; et al. "Developing Processing Routes for the Equal-Channel Angular Pressing of Age-Hardenable Aluminum Alloys." Metallurgical And Materials Transactions A, vol. 41A:802-809, Apr. 2010.

Ferrasse, S. et al., "Development of a submicrometer-grained microstructure in aluminum 6061 using equal channel angular extrusion", Journal of Materials Research, vol. 12, No. 5, pp. 1253-1261, May 1997.

Gao, Nong; et al. "Evolution of Microstructure and Precipitation in Heat-Treatable Aluminum Alloys During ECA Pressing And Subsequent Heat Treatment." Materials Science Forum, vols. 503-504, pp. 275-280, Jan. 15, 2006.

International Preliminary Report on Patentability received for PCT Patent Application No. PCT/US2019/056707, mailed on May 6, 2021, 7 pages.

International Search Report and Written Opinion received for PCT Patent Application No. PCT/US2017/063550, mailed on Feb. 8, 2018, 10 pages.

International Search Report and Written Opinion received for PCT Patent Application No. PCT/US2017/063562, mailed on Mar. 14, 2018, 9 pages.

(56) References Cited

OTHER PUBLICATIONS

International Search Report and Written Opinion received for PCT Patent Application No. PCT/US2019/056707, mailed on Feb. 7, 2020, 12 pages.

Kanetake, N.; et al. "Upgrading in Mechanical Properties of High Performance Aluminum Alloys By Compressive Torsion Process." International Conference on Manufacture of Lightweight Components—Manulight2014, Procedia CIRP, 18:57-61, 2014.

Ma, K. et al., "Mechanical behavior and strengthening mechanisms in ultrafine grain precipitation-strengthened aluminum alloy", Acta Materialia, vol. 62, pp. 141-155, available online Oct. 24, 2013.

Mishra, Rajiv S. "Processing Commercial Aluminum Alloys for High Strain Rate Superplasticity," JOM, Superplasticity, Overview, Mar. 2001, pp. 23-26.

Murashkin, M. Yu.; et al. "Strength of Commerical Aluminum Alloys After Equal Channel Angular Pressing And Post•ECAP Processing." Solid State Phenomena, 114:91-96, 2006.

Namoru Mabuchi et al. microstructure and mechnical properties of 5056 Al alloy processed by equal channel angular extrusion, Nanostructured Materials, vol. 8, No. 8, Dec. 1997, pp. 1105-1111.

Ruppert, M; et al. "Mechanical Properties of Ultrafine-Gralned AlZnMg(Cu)-Alloys AA7020 and AA7075 Processed by Accumulative Roll Bonding." J. Mater Sci., 50:4422-4429, 2015.

Segal, Vladimir M. "Fabrication of High-Strength Lightweight Metals for Armor and Structural Applications." Engineered Performance Materials Company, LLC, US Army Research Laboratory, Phase I Finai Report, Award Period of Jan. 27, 2011 to Mar. 8, 2012, 5 pages.

Shaban, M.; et al. "Plastic Deformation of 7075 Aluminum Alloy Using integrated Extrusion-Equal Channel Angular Pressing." Journal of Advanced Materials and Processing, 4(1):30-37, 2016.

Showa Denko K.K., "Showa Denko Develops High-Strength Version of ST60 Aluminum Plate," Published Apr. 25, 2016 [online], [retrieved on May 21, 2018]. Retrieved from the Internet <http://www.sdk.co.jp/english/news/2016/12589.html>.

Sun, Yiwei et al. (2014). Effect of Mg2Si Phase on Extrusion of AA6005 Aluminum Alloy. Light Metals; The Minerals, Metals & Materials Society, pp. 429-433.

Zhao, Y.H. et al., "Microstructures and mechanical properties of ultrafine grained 7075 alloy processed by ECAP andtheir evolutions during annealing", Acta Materialia, vol. 52, pp. 4589-4599, Available online Jul. 2, 2004.

* cited by examiner

ECAE PROCESSING FOR HIGH STRENGTH AND HIGH HARDNESS ALUMINUM ALLOYS

CROSS-REFERENCE TO RELATED APPLICATION

This application is a Divisional application of U.S. patent application Ser. No. 16/580,905, filed Sep. 24, 2019, which claims priority to Provisional Application No. 62/750,469, filed Oct. 25, 2018, both of which are herein incorporated by reference in their entireties.

TECHNICAL FIELD

The present disclosure relates to high strength and high hardness aluminum alloys which may be used, for example, in devices requiring high yield strength. More particularly, the present disclosure relates to high strength aluminum alloys that have high yield strength and which may be used to form stronger cases or enclosures for electronic devices. Methods of forming high-strength aluminum alloys and high-strength aluminum cases or enclosures for portable electronic devices are also described.

BACKGROUND

There is a general trend toward decreasing the size and weight of certain portable electronic devices, such as laptop computers, cellular phones, and portable music devices. There is a corresponding desire to decrease the size of the outer case or enclosure that holds the device. As an example, certain cellular phone manufacturers have decreased the thickness of their phone cases, for example, from about 8 mm to about 6 mm. Decreasing the size, such as the thickness, of the device case may expose the device to an increased risk of structural damage, both during normal use and during storage between uses, specifically due to device case deflection. Users handle portable electronic devices in ways that put mechanical stresses on the device during normal use and during storage between uses. For example, a user putting a cellular phone in a back pocket of his pants and sitting down puts mechanical stress on the phone which may cause the device to crack or bend. There is thus a need to increase the strength of the materials used to form device cases to minimize elastic or plastic deflection, dents, and any other types of damage.

SUMMARY

These and other needs are addressed by the various aspects and configurations of the present disclosure.

Various aspects of the present disclosure include a method of forming a high strength aluminum alloy, the method comprising: solutionizing an aluminum material, the aluminum material including aluminum as a primary component and at least one of magnesium and silicon as a secondary component at a concentration of at least 0.2% by weight, to a temperature ranging from about 5° C. above a standard solutionizing temperature to about 5° C. below an incipient melting temperature for the aluminum material to form a heated aluminum material; quenching the heated aluminum material rapidly in water to room temperature to form a cooled aluminum material; subjecting the cooled aluminum material to an equal channel angular extrusion (ECAE) process using one of isothermal conditions and non-isothermal conditions to form an aluminum alloy having a first yield strength: the isothermal conditions having a billet and a die at the same temperature from about 80° C. to about 200° C.; and, the non-isothermal conditions having a billet at a temperature from about 80° C. to about 200° C. and a die at a temperature of at most 100° C.; aging the aluminum alloy at a temperature from about 100° C. to about 175° C. for a time from about 0.1 to about 100 hours to form an aluminum alloy having a second yield strength, wherein the second yield strength is greater than the first yield strength.

The method of forming a high strength aluminum alloy described herein above, wherein the aluminum material is a precipitation hardened aluminum alloy.

The method(s) of forming a high strength aluminum alloy described herein above, wherein the aluminum material is an aluminum alloy 6xxx.

The method(s) of forming a high strength aluminum alloy described herein above, wherein the aluminum alloy 6xxx is chosen from AA6061 and AA6063.

The method(s) of forming a high strength aluminum alloy described herein above, wherein the solutionizing temperature is from 530° C. to 580° C.

The method(s) of forming a high strength aluminum alloy described herein above, wherein the solutionizing temperature is about 560° C.

The method(s) of forming a high strength aluminum alloy described herein above, the step of subjecting the cooled aluminum material using isothermal conditions, wherein the billet and the die are heated to the same temperature from about 105° C. to about 175° C.

The method(s) of forming a high strength aluminum alloy described herein above, wherein the billet and the die are heated to the same temperature of about 140° C.

The method(s) of forming a high strength aluminum alloy described herein above, the step of subjecting the cooled aluminum material using non-isothermal conditions, wherein the billet is heated to a temperature from about 105° C. to about 175° C. and the die is at a temperature of at most 80° C.

The method(s) of forming a high strength aluminum alloy described herein above, wherein the billet is heated to a temperature of about 140° C. and the die is at about room temperature.

The method(s) of forming a high strength aluminum alloy described herein above, further comprising subjecting the aluminum alloy to a thermo-mechanical process chosen from at least one of rolling, extrusion, and forging prior to the step of aging.

The method(s) of forming a high strength aluminum alloy described herein above, further comprising subjecting the aluminum alloy to a thermo-mechanical process chosen from at least one of rolling, extrusion, and forging after the step of aging.

The method(s) of forming a high strength aluminum alloy described herein above, wherein the step of subjecting the cooled aluminum material to the ECAE process includes at least two ECAE passes.

The method(s) of forming a high strength aluminum alloy described herein above, wherein the second yield strength of the aged aluminum alloy is at least 250 MPa.

The method(s) of forming a high strength aluminum alloy described herein above, the step of aging at a temperature of about 140° C. for a time of about 4 hours.

Various aspects of the present disclosure include a high strength aluminum alloy material comprising: aluminum as a primary component and at least one of magnesium and silicon as a secondary component at a concentration of at least 0.2% by weight; a Brinell hardness of at least 90 BHN;

a yield strength of at least 250 MPa; an ultimate tensile strength of at least 275 MPa; and, a percent elongation of at least 11.5%.

The high strength aluminum alloy described herein above, wherein the aluminum material contains from about 0.3 wt. % to about 3.0 wt. % magnesium and from about 0.2 wt. % to about 2.0 wt. % silicon.

The high strength aluminum alloy(s) described herein above, the Brinell hardness of at least 95 BHN, the yield strength of at least 275 MPa, and the ultimate tensile strength of at least 300 MPa.

The high strength aluminum alloy(s) described herein above, the Brinell hardness of at least 100 BHN, the yield strength of at least 300 MPa, the ultimate tensile strength of at least 310 MPa, and the percent elongation of at least 15%.

A device case formed of the high strength aluminum alloy described herein above.

While multiple embodiments are disclosed, still other embodiments of the present invention will become apparent to those skilled in the art from the following detailed description, which shows and describes illustrative embodiments of the invention. Accordingly, the drawings and detailed description are to be regarded as illustrative in nature and not restrictive.

DETAILED DESCRIPTION

Figure 1:
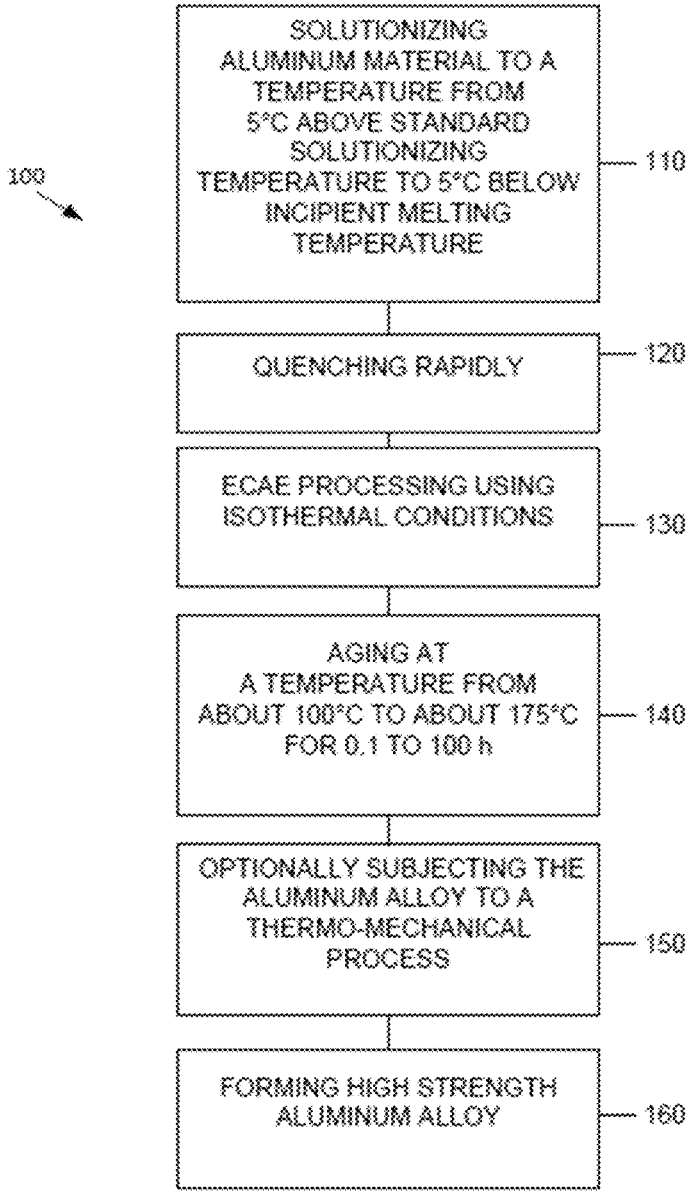
FIG. 1 is a flow chart showing an embodiment of a method of forming a high strength and high hardness aluminum alloy in accordance with the present disclosure.

Disclosed herein is a method of forming an aluminum (Al) alloy that has high hardness and yield strength. More particularly, described herein is a method of forming an aluminum alloy that has a hardness greater than 95 Brinell Hardness Number (BHN) and a yield strength greater than 250 MPa. In some embodiments, the aluminum alloy contains aluminum as a primary component and at least one secondary component. For example, the aluminum alloy may contain magnesium (Mg) and/or silicon (Si) as a secondary component at a concentration of at least 0.1 wt. % with a balance of aluminum. In some examples, the aluminum may be present at a weight percentage greater than about 90 wt. %. Methods of forming a high strength aluminum alloy including by equal channel angular extrusion (ECAE) are also disclosed. Methods of forming a high strength aluminum alloy having a yield strength from about 250 MPa to about 600 MPa and a Brinell hardness (BH) from about 95 to about 160 BHN including by ECAE using one of isothermal conditions and non-isothermal conditions, in combination with certain aging processes, are also disclosed.

In some embodiments, the methods disclosed herein may be carried out on an aluminum alloy having a composition containing aluminum as a primary component and magnesium and silicon as secondary components. For example, the aluminum alloy may have a concentration of magnesium of at least 0.2 wt. %. For example, the aluminum alloy may have a concentration of magnesium in the range from about 0.2 wt. % to about 2.0 wt. %, or about 0.4 wt. % to about 1.0 wt. % and a concentration of silicon in the range from about 0.2 wt. % to about 2.0 wt. %, or about 0.4 wt. % to about 1.5 wt. %. In some embodiments, the aluminum alloy may be one of an Al 6xxx series alloy. In some embodiments, the aluminum alloy may have a concentration of trace elements such as iron (Fe), copper (Cu), manganese (Mn), chromium (Cr), zinc (Zn), titanium (Ti), and/or other elements. The concentration of trace elements may be as follows: at most 0.7 wt. % Fe, at most 1.5 wt. % Cu, at most 1.0 wt. % Mn, at most 0.35 wt. % Cr, at most 0.25 wt. % Zn, at most 0.15 wt. % Ti, and/or at most 0.0.5 wt. % other elements not to exceed 0.15 wt. % total other elements. In some embodiments, the aluminum alloy is chosen from AA6061 and AA6063, also referred to interchangeably herein as Al6061 and Al6063 respectively. In some embodiments, the aluminum material is a precipitation hardened aluminum alloy. In some embodiments, the aluminum alloy may have a yield strength from about 250 MPa to about 600 MPa, from about 275 MPa to about 500 MPa, or from about 300 MPa to about 400 MPa. In some embodiments, the aluminum alloy may have an ultimate tensile strength from about 275 MPa to about 600 MPa, from about 300 MPa to about 500 MPa, or from about 310 MPa to about 400 MPa. In some embodiments, the aluminum alloy may have a Brinell hardness of at least about 90 BHN, at least about 95 BHN, at least about 100 BHN, at least about 105 BHN, or at least about 110 BHN. In some embodiments, the aluminum alloy may have a Brinell hardness upper limit of about 160 BHN.

A method 100 of forming a high strength aluminum alloy having magnesium and silicon is shown in FIG. 1. The method 100 includes solutionizing a starting material in step 110. For example, the starting material may be an aluminum material cast into a billet form. The aluminum material may include additives, such as other elements, which will alloy with aluminum during method 100 to form an aluminum alloy. In some embodiments, the aluminum material billet may be formed using standard casting practices for an aluminum alloy having magnesium and silicon. Solutionizing need not be performed right away after casting as with homogenizing. The aluminum material billet may be subjected to solutionizing in step 110, and the temperature and time of the solutionizing may be specifically tailored to a particular alloy. The temperature and time may be sufficient such that the secondary components are dispersed throughout the aluminum material to form a solutionized aluminum material, in other words, to put magnesium and silicon into solid solution and to be available as precipitation sites during other thermal processes, such as aging for example. The secondary components may be dispersed throughout the aluminum material such that the solutionized aluminum material is substantially homogenous. The solutionizing temperature according to the present disclosure may range in temperature from about 5° C. above a standard solutionizing temperature to about 5° C. below an incipient melting temperature for the aluminum material to form a heated aluminum material. In some embodiments, a suitable temperature for the solutionizing may be from about 530° C. to about 580° C., from about 550° C. to about 570° C., or may be about 560° C. In some embodiments, a suitable temperature for the solutionizing may be from 530° C. to 580° C. The upper limit of about 580° C. is due to incipient melting. The solutionizing temperature lower limit according to the present disclosure is 10° C. higher than the standard 520° C. solutionizing temperature for Al6063 per ASM (American Society for Metals) standards reference material. For other Al6xxx alloys, the solutionizing temperature may be slightly higher, for example up to 530° C. The method according to the present disclosure includes solutionizing at a temperature of at least 5° C. or at least 10° C. higher than is standard for the specific alloy material. Certain solutionizing may be performed to improve structural uniformity and subsequent workability of billets. In some embodiments, solutionizing may lead to the precipitation occurring homogenously, which may contribute to a higher attainable strength and better stability of precipitates during subsequent processing. In some embodiments, solutionizing an aluminum material including aluminum as a primary component and at least one of magnesium and silicon as a secondary component at a concentration of at least 0.2% by weight is performed at a temperature from about 530° C. to about 580° C. to form a heated aluminum material. In some embodiments, the solutionizing temperature is from about 530° C. to about 560° C. In some embodiments, the solutionizing temperature is from 530° C. to 560° C. In some embodiments, the solutionizing temperature is about 560° C. In some embodiments, the solutionizing temperature is 560° C. The goal of solutionizing is to dissolve the additive elements, such as magnesium and/or silicon, or other trace elements as desired, into the aluminum material to form an aluminum alloy. Solutionizing may be carried out for a suitable duration based on the size, such as the cross-sectional area, of the billet. For example, the solutionizing may be carried out for from about 30 minutes to about 8 hours, from 1 hour to about 6 hours, or from about 2 hours to about 4 hours, depending on the cross section of the billet. As an example, the solutionizing may be carried out at from about 530° C. to about 580° C. for up to 8 hours. While longer times than 8 hours, for example 24 hours may not be deleterious, there would be no expected gain in microstructure or mechanical properties for aging times over 8 hours.

The solutionizing may be followed by quenching, as shown in step 120. For standard metal casting, heat treatment of a cast piece is often carried out near the solidus temperature (i.e. solutionizing) of the cast piece, followed by rapidly cooling the cast piece by quenching the cast piece to about room temperature or lower. This rapid cooling retains any elements dissolved into the cast piece at a higher concentration than the equilibrium concentration of that element in the aluminum alloy at room temperature. In some embodiments, the solutionized, heated aluminum is quenched rapidly in water (or oil), to room temperature to form a cooled aluminum material.

In some embodiments, the cooled aluminum material may be subjected to severe plastic deformation such as equal channel angular extrusion (ECAE), as shown in step 130. For example, the aluminum alloy billet may be passed through an ECAE device including a die to extrude the aluminum alloy as a billet having a square, rectangular, or circular cross section. The ECAE process may be carried out at relatively low temperatures compared to the solutionizing temperature of the particular aluminum alloy being extruded. For example, ECAE of an aluminum alloy having magnesium and silicon may be carried out using one of isothermal condition and non-isothermal conditions. In some embodiments using isothermal conditions, during the extrusion, the aluminum alloy material being extruded and the extrusion die may be maintained at the temperature that the extrusion process is being carried out at to ensure a consistent temperature throughout the aluminum alloy material. That is, the extrusion die may be heated to prevent the aluminum alloy material from cooling during the extrusion process. Using isothermal conditions means that the aluminum billet and the ECAE die are at the same temperature from about 80° C. to about 200° C., or from about 105° C. to about 175° C., or from about 125° C. to about 150° C. In some embodiments, the ECAE process may include one pass, two passes, three passes, or four passes or more extrusion passes through the ECAE device. The aluminum alloy formed has a first yield strength $YS_1$.

For non-ECAE processed materials, the standard aging heat treatment for Al 6063 T6 temper may be 175° C. for 8 hours. However, for ECAE processed alloys, the 175° C., 8 hours heat treatment condition is not preferred because precipitation happens faster in submicron ECAE materials.

In some embodiments, aging according to the present disclosure may be optionally carried out after the ECAE process, as shown in step 140. In some embodiments, the aging heat treatment may be carried out at temperatures from about 100° C. to about 175° C. for a duration of 0.1 hours to about 100 hours. The aging heat treatment temperature may be about 100° C., about 105° C., about 110° C., about 120° C., about 130° C., about 140° C., about 150° C., about 160° C., about 170° C., about 175° C., in some embodiments, the aging heat treatment temperature is from about 100° C. to about 175° C., from about 120° C. to about 160° C., or from about 130° C. to about 150° C. In some embodiments, the aging heat treatment temperature is about 140° C. The aging heat treatment time may be about 0.1 hours, about 0.2 hours, about 0.3 hours, about 0.4 hours, about 0.5 hours, about 0.6 hours, about 0.7 hours, about 0.8 hours, about 0.9 hours, about 1 hour, about 2 hours, about 3 hours, about 4 hours, about 5 hours, about 6 hours, about 7 hours, about 8 hours, about 9 hours, about 10 hours, about 20 hours, about 40 hours, about 60 hours, about 80 hours, or about 100 hours, in some embodiments, the aging heat treatment time is from about 0.1 hours to about 100 hours, from about 1 hour to about 20 hours, or from about 6 hours to about 10 hours. In some embodiments, the aging heat treatment time is about 8 hours.

Following severe plastic deformation by ECAE and aging, the aluminum alloy may optionally undergo further plastic deformation via a thermo-mechanical process, such as rolling in step 150, to further tailor the aluminum alloy properties and/or change the shape or size of the aluminum alloy. The thermo-mechanical process may be chosen from at least one of rolling, extrusion, and forging. Cold working (such as stretching) may be used to provide a specific shape or to stress relieve or straighten the aluminum alloy billet. For plate applications where the aluminum alloy is to be a plate, rolling may be used to shape the aluminum alloy.

After the aging of step 140 and optionally subjecting the aluminum alloy to a thermo-mechanical process as in step 150, a high strength aluminum alloy is formed as in step 160. The high strength aluminum alloy has a second yield strength $YS_2$, wherein the second yield strength $YS_2$ is greater than the first yield strength $YS_1$.

Figure 2:
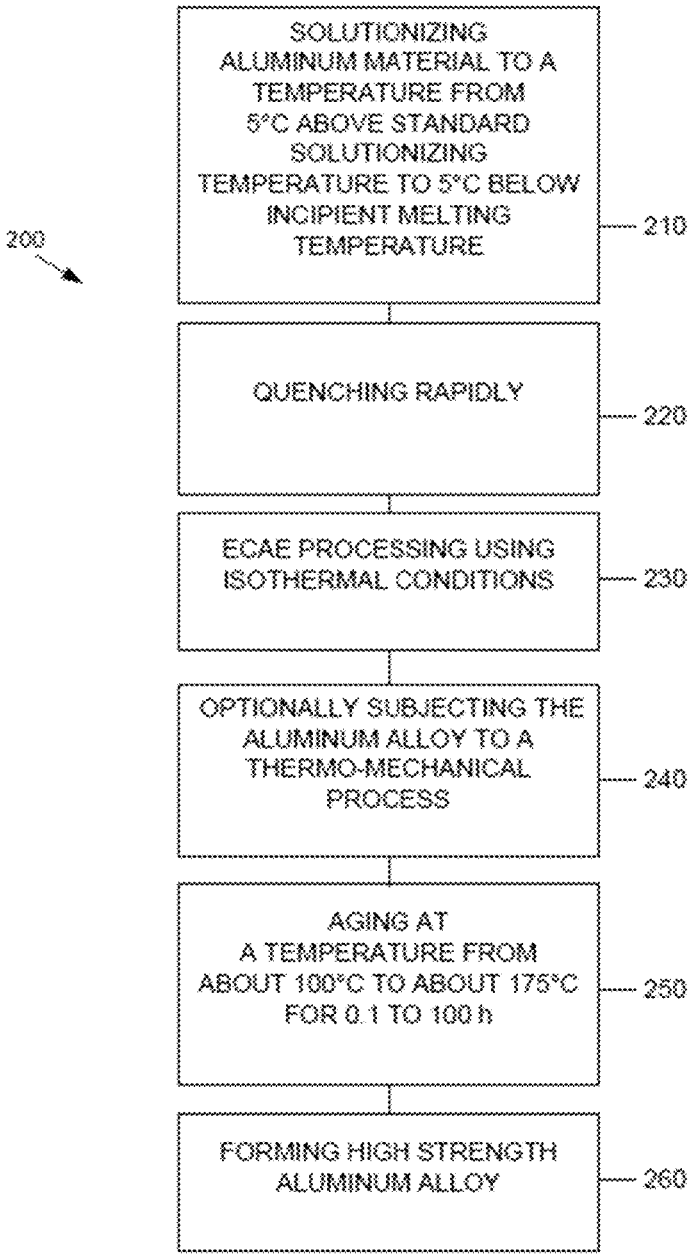
FIG. 2 is a flow chart showing an alternative embodiment of a method of forming a high strength and high hardness aluminum alloy in accordance with the present disclosure.

FIG. 2 is a flow chart of a method 200 of forming a high strength aluminum alloy. The method 200 includes solutionizing in step 210, quenching rapidly in step 220, and ECAE processing as in step 230. Steps 210, 220, and 230 may be the same as or similar to steps 110, 120, and 130 described herein with respect to FIG. 1. Optionally the aluminum alloy is subjected to a thermo-mechanical process as in step 240. The thermo-mechanical process may be chosen from at least one of rolling, extrusion, and forging. In some embodiments, aging may be optionally carried out after the subjecting to a thermo-mechanical process as in step 240, as shown in step 250. In some embodiments, the aging heat treatment may be carried out at temperatures from about 100° C. to about 175° C. for a duration of 0.1 hours to about 100 hours. After the aging of step 250, a high strength aluminum alloy is formed as in step 260.

Figure 3:
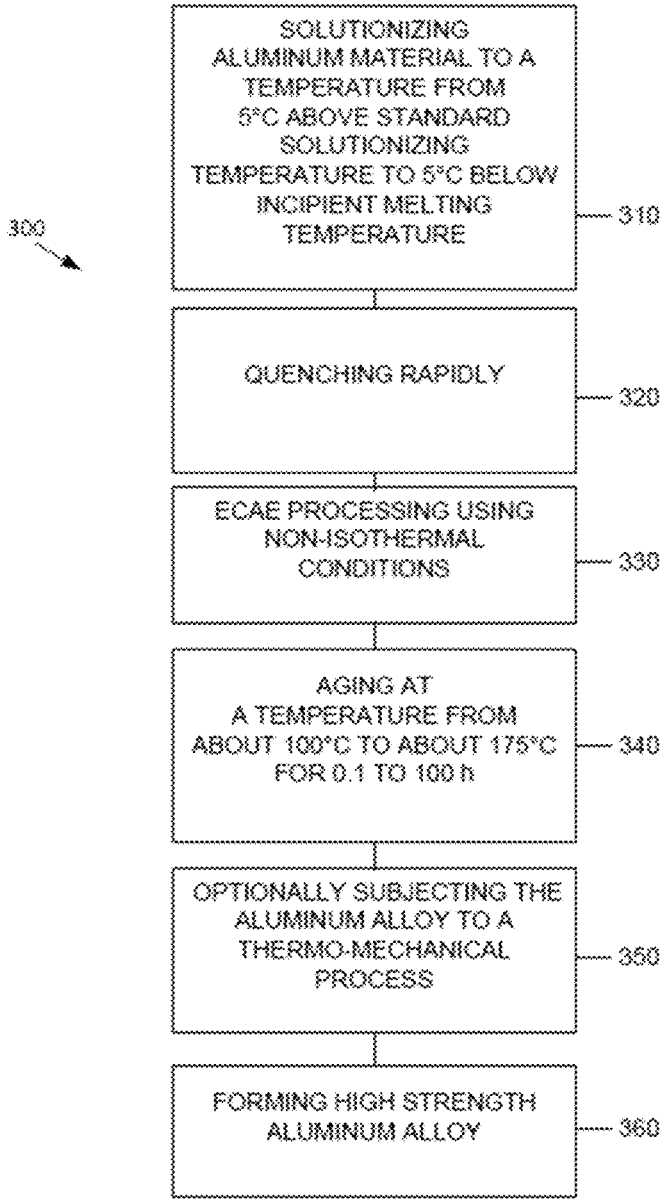
FIG. 3 is a flow chart showing an alternative embodiment of a method of forming a high strength and high hardness aluminum alloy in accordance with the present disclosure.

FIG. 3 is a flow chart of a method 300 of forming a high strength aluminum alloy. The method 300 includes solutionizing in step 310, quenching rapidly in step 320, and ECAE processing as in step 330. Steps 310 and 320 may be the same as or similar to steps 110 and 120 described herein with respect to FIG. 1. The ECAE processing of step 330 uses non-isothermal conditions. In embodiments using non-isothermal conditions, the extrusion die may be cooler relative to the billet temperature during the extrusion process. Using non-isothermal conditions means that the aluminum billet and the ECAE die are at different temperatures, wherein the aluminum billet is at a temperature from about 80° C. to about 200° C., or from about 105° C. to about 175° C., or from about 125° C. to about 150° C. while the die is at a temperature of about 100° C. or less, or about 80° C., or about 60° C., or about 40° C., or about 25° C. or about room temperature. In some embodiments, the ECAE process may include one pass, two or more passes, or four or more extrusion passes through the ECAE device. In some embodiments, aging may be optionally carried out after the ECAE processing as in step 330, as shown in step 340. In some embodiments, the aging heat treatment of step 340 may be carried out at temperatures from about 100° C. to about 175° C. for a duration of 0.1 hours to about 100 hours. Optionally the aluminum alloy is subjected to a thermo-mechanical process as in step 350. The thermo-mechanical process may be chosen from at least one of rolling, extrusion, and forging. After the aging of step 340 and optionally subjecting the aluminum alloy to a thermo-mechanical process as in step 350, a high strength aluminum alloy is formed as in step 360.

Figure 4:
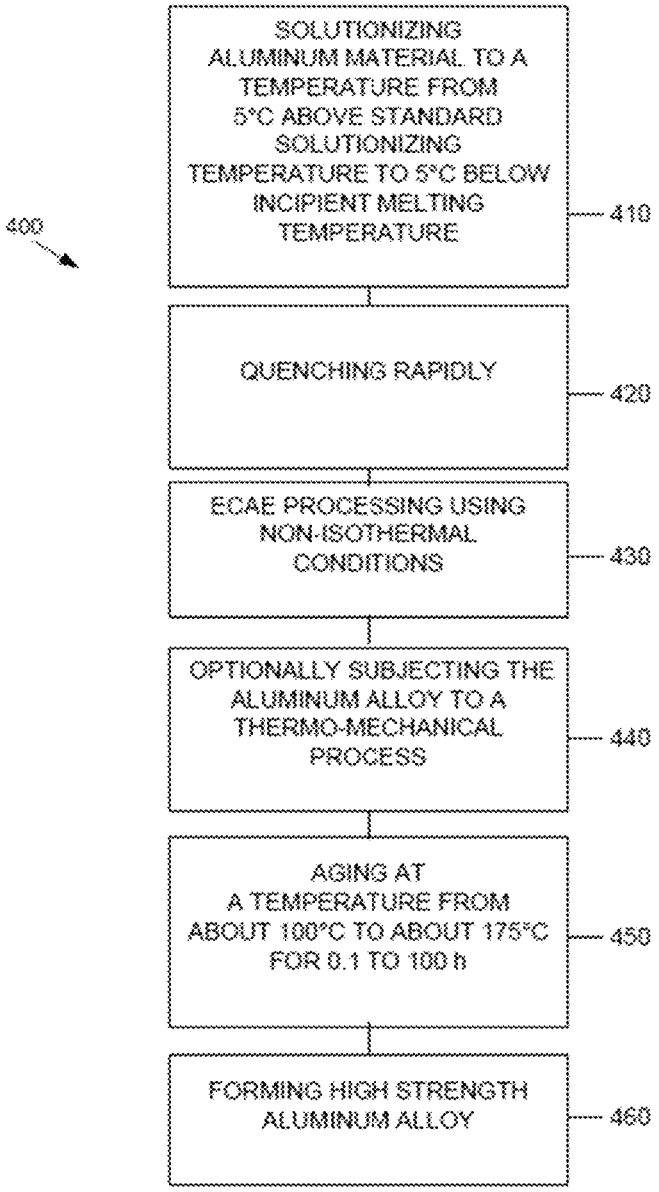
FIG. 4 is a flow chart showing an alternative embodiment of a method of forming a high strength and high hardness metal alloy in accordance with the present disclosure.

FIG. 4 is a flow chart of a method 400 of forming a high strength aluminum alloy. The method 400 includes solutionizing in step 410, quenching rapidly in step 420, and ECAE processing as in step 430. Steps 410, 420, and 430 may be the same as or similar to steps 310, 320, and 330 described herein with respect to FIG. 3. The ECAE processing of step 430 uses non-isothermal conditions, which are the same as or similar to step 330. Optionally the aluminum alloy is subjected to a thermo-mechanical process as in step 440 prior to aging as in step 450. The thermo-mechanical process may be chosen from at least one of rolling, extrusion, and forging. In some embodiments, the aging heat treatment of step 450 may be carried out at temperatures from about 100° C. to about 175° C. for a duration of 0.1 hours to about 100 hours. After the aging of step 450, a high strength aluminum alloy is formed as in step 460.

The methods shown in FIGS. 1 to 4 may be applied to aluminum alloys having one or more additional components. For example, the aluminum alloys may contain at least one of magnesium and silicon with a concentration of magnesium in the range from about 0.3 wt. % to about 3.0 wt. %, 0.5 wt. % to about 2.0 wt. %, or 0.5 wt. % to about 1.5 wt. % and a concentration of silicon in the range from about 0.2 wt. % to about 2.0 wt. % or 0.4 wt. % to about 1.5 wt. %. For example, the aluminum alloy may be one of an Al 6xxx series alloy. In some embodiments, the aluminum alloy may have a concentration of trace elements such as iron (Fe), copper (Cu), manganese (Mn), chromium (Cr), zinc (Zn), titanium (Ti), and/or other elements. The concentration of trace elements may be as follows: at most 0.7 wt. % Fe, at most 1.5 wt. % Cu, at most 1.0 wt. % Mn, at most 0.35 wt. % Cr, at most 0.25 wt. % Zn, at most 0.15 wt. % Ti, and/or at most 0.0.5 wt. % other elements not to exceed 0.15 wt. % total other elements. In some embodiments, the aluminum alloy 6xxx is chose from AA6061 and AA6063.

In some embodiments, the methods of FIGS. 1 to 4 may be applied to aluminum alloys that are suitable for use in portable electronic device cases due to high yield strength (i.e., a yield strength from 300 MPa to 600 MPa), a low weight density (i.e., about 2.8 g/cm$^3$), and relative ease of manufacturing to complex shapes.

As described herein the mechanical properties of these aluminum alloys can be improved by subjecting the alloy to severe plastic deformation (SPD). As used herein, severe plastic deformation includes extreme deformation of bulk pieces of material. In some embodiments, ECAE provides suitable levels of desired mechanical properties when applied to the materials described herein.

Figure 5:
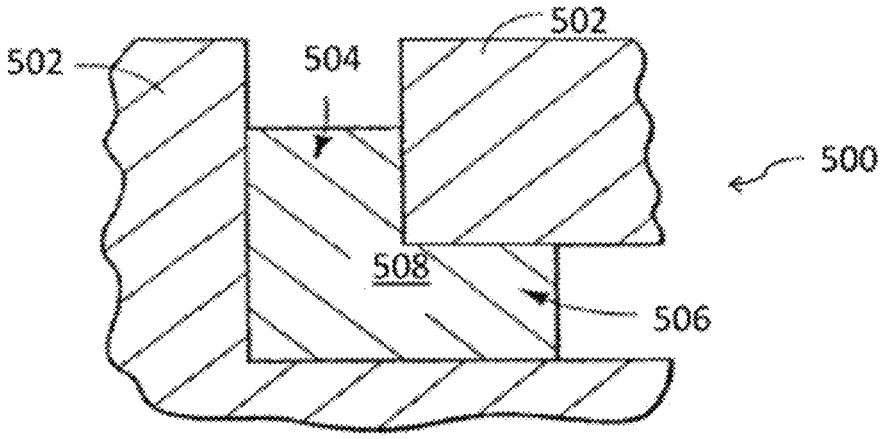
FIG. 5 is a schematic view of a sample equal channel angular extrusion device.

ECAE is an extrusion technique which consists of two channels of roughly equal cross-sections meeting at a certain angle comprised practically between 90° and 140°. An example ECAE schematic of an ECAE device 500 is shown in FIG. 5. As shown in FIG. 5, an exemplary ECAE device 500 includes a mold assembly 502 that defines a pair of intersecting channels 504 and 506. The intersecting channels 504 and 506 are identical or at least substantially identical in cross-section, with the term "substantially identical" indicating the channels are identical within acceptable size tolerances of an ECAE apparatus. In operation, a material 508 is extruded through channels 504 and 506. Such extrusion results in plastic deformation of the material 508 by simple shear, layer after layer, in a thin zone located at the crossing plane of the channels. In some embodiments, then channels 504 and 506 intersect at an angle of about 90° to produce a sufficient deformation (i.e., true shear strain). For example, a tool angle of 90° may result in true strain that is about 1.17 per each ECAE pass. However, it is to be understood that an alternative tool angle, for example an angle greater than 90°, can be used (not shown).

ECAE provides high deformation per pass, and multiple passes of ECAE can be used in combination to reach extreme levels of deformation without changing the shape and volume of the billet after each pass. Rotating or flipping the billet between passes allows various strain paths to be achieved. This allows control over the formation of the crystallographic texture of the alloy grains and the shape of various structural features such as grains, particles, phases, cast defects or precipitates. Grain refinement is enabled with ECAE by controlling three main factors: (i) simple shear, (ii) intense deformation and (iii) taking advantage of the various strain paths that are possible using multiple passes of ECAE. ECAE provides a scalable method, a uniform final product, and the ability to form a monolithic piece of material as a final product.

Because ECAE is a scalable process, large billet sections and sizes can be processed via ECAE. ECAE also provides uniform deformation throughout the entire billet cross-section because the cross-section of the billet can be controlled during processing to prevent changes in the shape or size of the cross-section. Also, simple shear is active at the intersecting plane between the two channels.

ECAE involves no intermediate bonding or cutting of the material being deformed. Therefore, the billet does not have a bonded interface within the body of the material. That is, the produced material is a monolithic piece of material with no bonding lines or interfaces where two or more pieces of previously separate material have been joined together. Interfaces can be detrimental because they are a preferred location for oxidation, which is often detrimental. For example, bonding lines can be a source for cracking or delamination. Furthermore, bonding lines or interfaces are responsible for non-homogeneous grain size and precipitation and result in anisotropy of properties.

In some instances, the aluminum alloy billet may crack during ECAE. In certain aluminum alloys, a high diffusion rate of constituents in the aluminum alloy may affect processing results. In some embodiments, carrying out ECAE at increased temperatures may avoid cracking of the aluminum alloy billet during ECAE. For example, increasing the temperature that the aluminum alloy billet is held at during extrusion may improve the workability of the aluminum alloy and make the aluminum alloy billet easier to extrude. However, increasing the temperature of the aluminum alloy generally leads to undesirable grain growth, and in heat treatable aluminum alloys, higher temperatures may affect the size and distribution of precipitates. The altered precipitate size and distribution may have a deleterious effect on the strength of the aluminum alloy after processing. This may be the result when the temperature and time used during ECAE are above the temperature and time that correspond to peak hardness for the aluminum alloy being processed, i.e. above the temperature and time conditions that correspond to peak aging. Carrying out ECAE on an aluminum alloy with the alloy at a temperature too close to the peak aging temperature of the aluminum alloy may thus not be a suitable technique for increasing the final strength of certain aluminum alloys even though it may improve the billet surface conditions (i.e. reduce the number of defects produced).

Keeping the above considerations in mind, it has been found that particular processing parameters may improve the outcome of ECAE processes for aluminum alloys having magnesium and/or silicon. These parameters are outlined further in the examples below.

The pre-ECAE heat treatment includes solutionizing the Al Alloy having magnesium and silicon. Typically, producing stable Guinier Preston (GP) zones and establishing thermally stable precipitates in an aluminum alloy before performing ECAE may improve workability which, for example, may lead to reduced billet cracking during ECAE. This is important for ECAE processing of aluminum alloys having magnesium and silicon because these alloys have a fairly unstable sequence of precipitation, and high deformation during ECAE makes the alloy even more unstable unless the processing conditions are carefully controlled.

The effects of heat and time on precipitation in an aluminum alloy having magnesium and silicon have been evaluated. The sequence of precipitation in an aluminum alloy having magnesium and silicon is complex and dependent on temperature and time. It was discovered that critical optimization of processing parameters improved the aluminum alloy material according to the present disclosure as compared with Al 6063, standard temper T6 also referred to interchangeably herein as Al 6063 T6. These optimized processing parameters include solutionizing temperature, temperature of ECAE billet and temperature of ECAE die during ECAE processing, and aging temperature and time.

Figure 6:
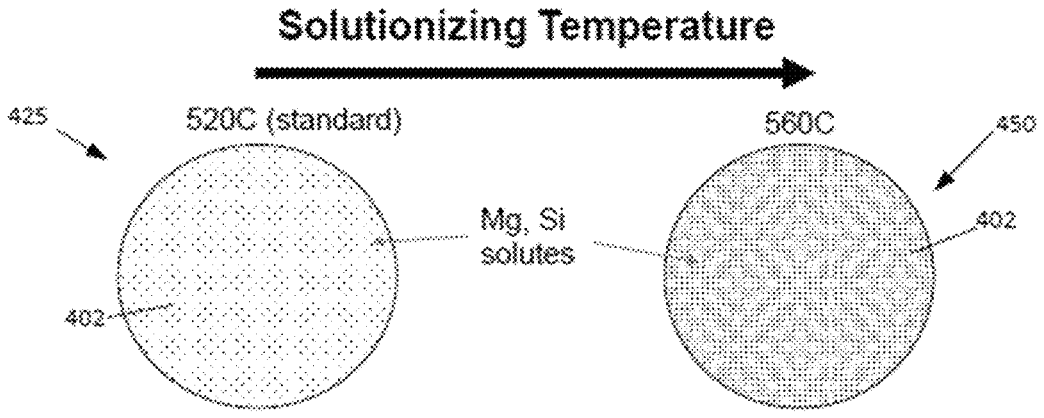
FIG. 6 is a schematic illustrating effect of solutionizing temperature at 520° C. and 560° C. on precipitate solutes.

First, using high temperature heat treatment such as solutionizing, solutes such as magnesium and/or silicon are put in solution by distributing throughout the aluminum alloy. FIG. 6 schematically shows the effect of the higher solutionizing temperature. This alloy material 450 having solutionizing temperature 560° C. forms more silicon and magnesium in solution, as represented by the higher density of dots 410, as compared with a similar material 425 solutionized at the standard temperature of 520° C. The high temperature heat treatment is followed by rapid cooling in water (or oil), also known as quenching, to hold the solutes in solution. By increasing the temperature from the standard 520° C. (for Al 6063 T6 for example) to from about 530° C. to about 560° C. provides more silicon and magnesium into solid solution during quenching and creates more (Mg, Si) precipitates available for precipitation strengthening during subsequent heat treatments. At relatively low temperatures for long time periods and during initial periods of artificial aging at moderately elevated temperatures, the principal change is a redistribution of solute atoms within the solid solution lattice to form clusters termed Guinier Preston (GP) zones that are considerably enriched in solute. This local segregation of solute atoms produces a distortion of the alloy lattice. The strengthening effect of the zones is a result of the additional interference with the motion of dislocations when they cut the GP zones. The progressive strength increase with aging time at room temperature (defined as natural aging) has been attributed to an increase in the size of the GP zones.

In most systems, as aging time or temperature are increased, the GP zones are either converted into or replaced by particles having a crystal structure distinct from that of the solid solution and also different from the structure of the equilibrium phase. Those are referred as "transition" or "metastable" or "intermediate" precipitates. In many alloys, the first "transition" precipitates have a specific crystallographic orientation relationship with the solid solution, such that they are coherent with aluminum matrix on certain crystallographic planes by adaptation of the matrix through local elastic strain. Strength continues to increase as the size and number of these first "transition" precipitates increase. The strengthening mechanism is provided by how easily a dislocation can move through a material. Any precipitates that impedes the movement of a dislocation will add strength to the alloy. For the first transition precipitates that are very small and coherent with the aluminum matrix, dislocations cut and shear through a precipitate. Further progress of the precipitation reaction produces growth of "transition" phase particles, with an accompanying increase in coherency strains until the strength of interfacial bond is exceeded and coherency disappears: this leads to the formation of new semi coherent transition precipitates that replace progressively the first type of transition precipitates With loss of coherency, strengthening effects are caused by the stress required to cause dislocations to loop around rather than to cut precipitates. Additional heat treatment during aging for longer time and temperature causes precipitates to become larger and incoherent with matrix and this coincides with the formation of equilibrium precipitates. Strength progressively decreases with growth of equilibrium phase particles and an increase in inter-particle spacing. This last phase corresponds to overaging and in some embodiments is not suitable when the main goal is to achieve maximum strength. More specifically, for magnesium and silicon containing Al alloys, the sequence for precipitation starts with the formation of GP zones from clusters of Si and Mg atoms around vacancies followed by the formation of coherent transition β" precipitates that have a needle shape followed by the formation of semi-coherent transition β' precipitates that are rod shaped and finally the formation of larger incoherent equilibrium β-Mg2Si precipitates. Peak strength during aging (also referred as peak aging) occurs usually during the β" to β' transformation due to the fine size of precipitates that slow down dislocation motion by shearing and/or bowing.

The GP zone nucleates homogeneously within the lattice and the various precipitates develop sequentially. However, the presence of grain boundaries, subgrain boundaries, dislocations and lattice distortions alters the free energy of zone and precipitate formation and significant heterogeneous nucleation may occur. These effects may be enhanced when extreme levels of plastic deformation are introduced, for example during ECAE, directly after the solutionizing and quenching steps. ECAE introduces a high level of subgrain, grain boundaries and dislocations that may enhance heterogeneous nucleation and precipitation and therefore lead to a non-homogenous distribution of precipitates. GP zones or precipitates may decorate dislocations and inhibit their movement which leads to a reduction in local ductility. Even at room temperature processing, there is some level of adiabatic heating occurring during ECAE that provides energy for faster nucleation and precipitation. These interactions may happen dynamically during each ECAE pass.

Figure 7:
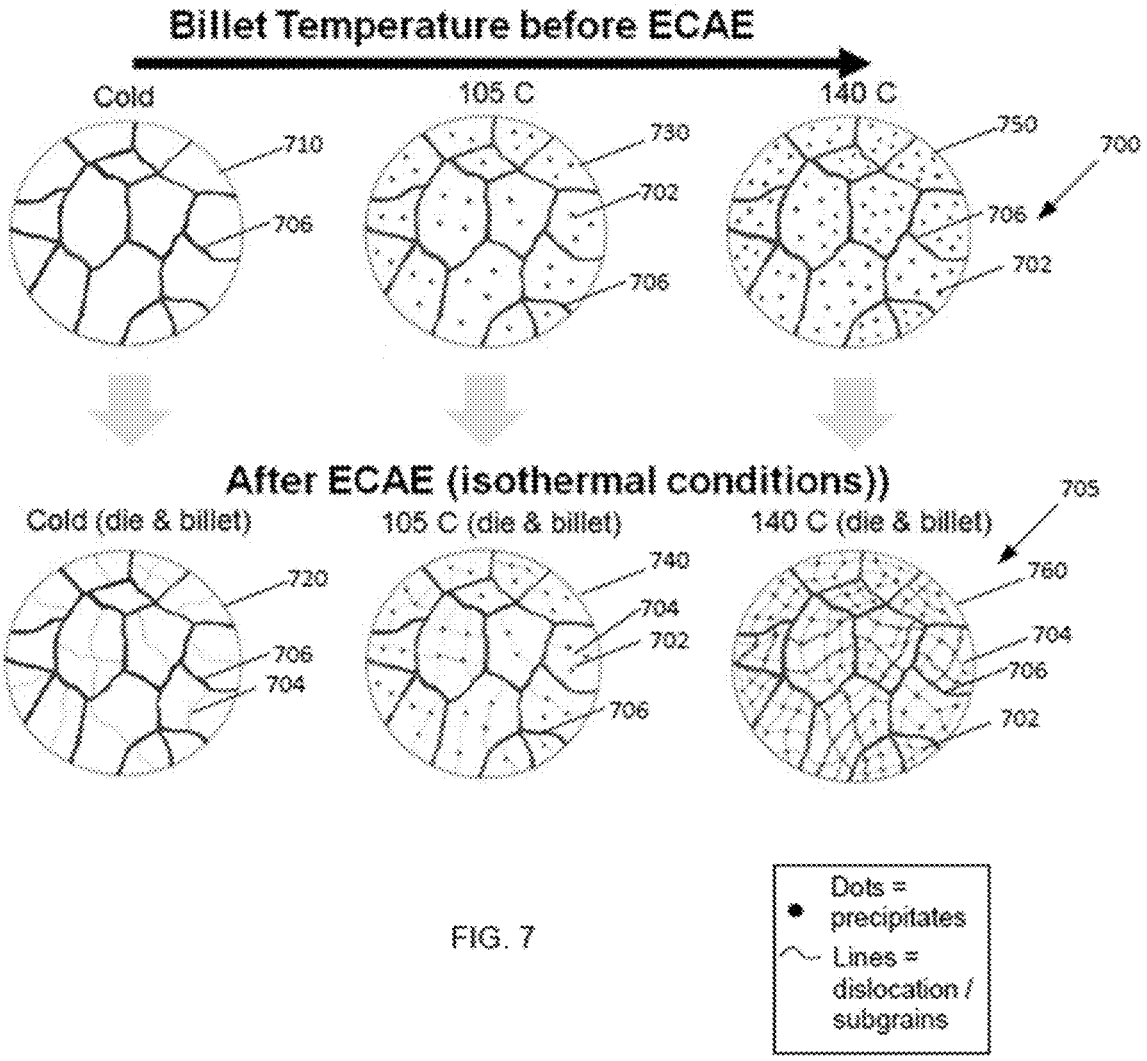
FIG. 7 is a schematic illustrating microstructural features (precipitate and dislocations/subgrains) before and after ECAE at cold (room temperature) and under isothermal conditions (billet and die at same temperature) at 105° C. and 140° C. for aluminum alloys in accordance with the present disclosure.

The effect of ECAE die temperature and billet temperature was examined and is shown schematically in FIG. 7. Schematic 700, showing increasing temperature for billets before ECAE, illustrates microstructure 710 for cold or room temperature condition, microstructure 730 for 105° C., and microstructure 750 for 140° C. Schematic 705, showing increasing temperature for billets after ECAE wherein the die was held at the same temperature for isothermal conditions, illustrates microstructure 720 for cold or room temperature condition, microstructure 740 for 105° C., and microstructure 760 for 140° C. It was discovered that a higher billet temperature before ECAE provides more precipitates of $Mg_2Si$ as illustrated in schematic 700 by the increase of precipitates or dots 702 comparing cold (e.g. room temperature) condition microstructure 710 substantially devoid of precipitates to microstructure 730 for a billet heated to 105° C. having moderate density of precipitates to microstructure 750 for a billet heated to 140° C. having a higher density of precipitates. The dislocations 704 created during ECAE, and as illustrated in schematic 705, are pinned by precipitates 702. The increase in dislocations 704 contributes to an increase in subgrains (having boundaries 704) within original grains (having boundaries 706, indicated by bold lines) and results in more strength. It was discovered that a higher billet temperature, wherein the die temperature is isothermally maintained, as illustrated in schematic 705 provides for more dislocations and subgrains after ECAE. The increase of dislocations/subgrains 704 is shown in comparing cold (e.g. room temperature) condition microstructure 720 having low density of dislocations/subgrains to microstructure 740 isothermally at 105° C. having moderate density of dislocations/subgrains to microstructure 760 isothermally at 140° C. having a higher density of dislocations/subgrains. These effects of higher density of precipitates (with increasing billet temperature) and dislocations/subgrains (with increasing temperature of both die and billet at isothermal conditions) remain even after post ECAE peak aging, which will be discussed in more detail below.

Figure 8:
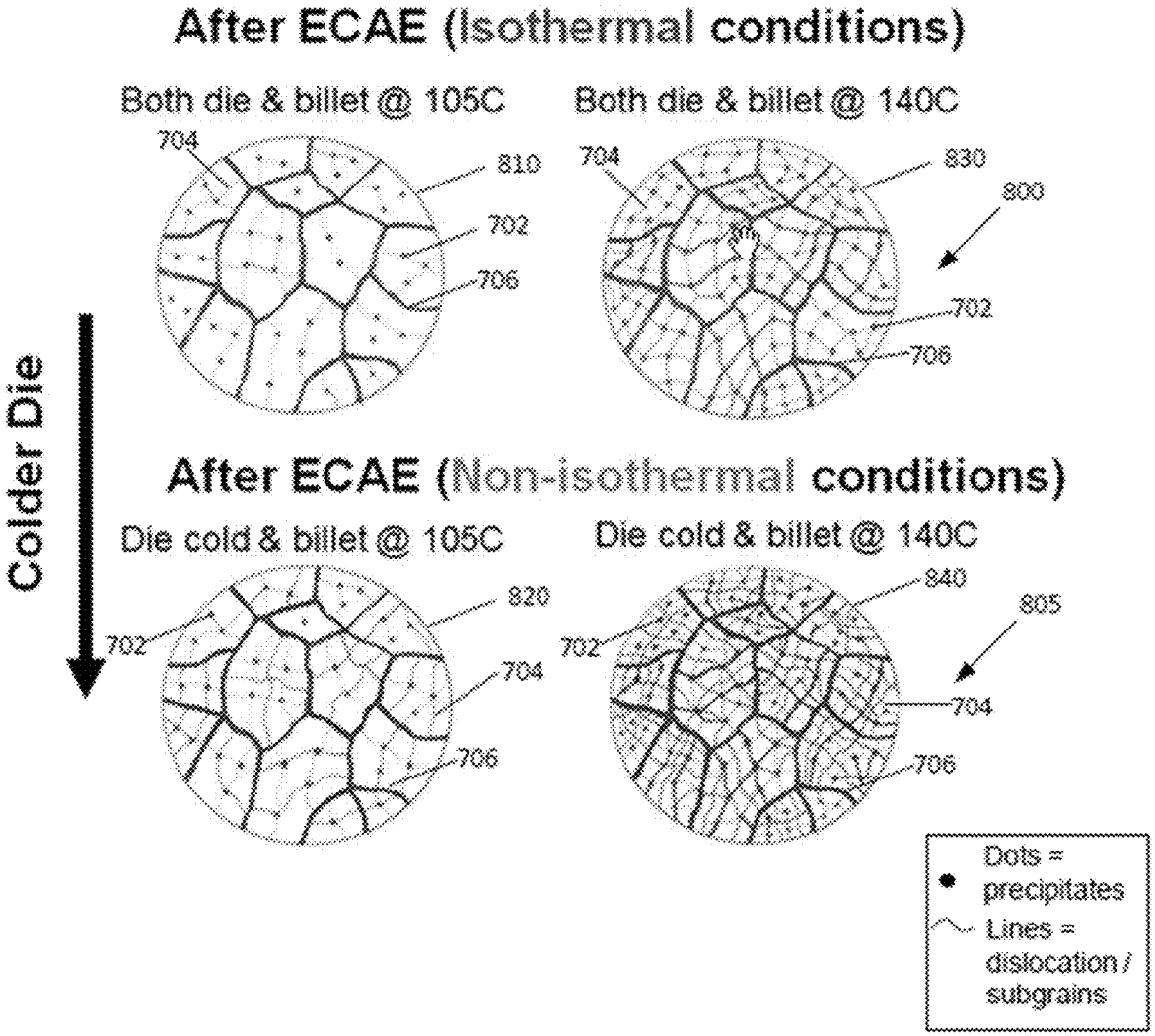
FIG. 8 is a schematic illustrating microstructural features after ECAE under isothermal conditions as compared with non-isothermal conditions for aluminum alloys in accordance with the present disclosure.

FIG. 8 schematically illustrates the effect of isothermal conditions 800 as compared with non-isothermal conditions 805 on density of precipitates 702 and dislocations or subgrains 704 within grain boundaries 806. It was surprisingly determined that non-isothermal conditions, in other words having a die at a temperature lower or colder than the billet temperature, resulted in a higher density of precipitates 702 and dislocations or subgrains 704 as compared with isothermal conditions (for a same billet temperature). Schematic 800 demonstrates microstructure 810, wherein both billet and ECAE die are held isothermally at 105° C., having a lower density of precipitates 702 and dislocations/subgrains 704 after ECAE as compared with microstructure 830, wherein both billet and ECAE die are held isothermally at 140° C. Similarly, schematic 805 demonstrates microstructure 820, having a cold die but with the billet at 105° C., having a lower density of precipitates 702 and dislocations or subgrains 704 after ECAE as compared with microstructure 840, having a cold die but with the billet at 140° C. Comparing microstructures 810 and 820 there is a higher density of dislocations/subgrains 704 for microstructure 820 having non-isothermal conditions (cold die) wherein billets were heat treated at 105° C. Likewise comparing microstructures 830 and 840 there is a higher density of dislocations/subgrains 704 for microstructure 840 having non-isothermal conditions (cold die) wherein the billets were at 140° C. The die temperature being colder than the billet temperature resulted in more dislocations remaining after ECAE, and without being bound by theory, due at least in part to less recovery results in more strength. These effects were observed to be limited to temperatures of the billet of up to about 150° C., above which results in deleterious effects.

Some of the potentially detrimental consequences are as follows. A propensity for surface cracking of the billet due to a loss in local ductility and heterogeneous precipitate distribution. This effect is most severe at the top billet surface. Another effect may be to limit the number of ECAE passes that can be used. As the number of passes increases the effects become more severe and cracking becomes more likely. A decrease in the maximum achievable strength during ECAE, partly due to heterogeneous nucleation effects and partly due to limitation of the number of ECAE passes, which affects the ultimate level of grain size refinement.

In some embodiments, it was found that process optimization included a post ECAE aging heat treatment, which could be performed before or after a further thermo-mechanical process chosen from at least one of rolling, extrusion, and forging. The aging heat treatment at a temperature from about 100° C. to about 175° C. for a time from about 0.1 to about 100 hours provides a distribution of precipitates that is stable to form an aluminum alloy having a second yield strength, wherein the second yield strength is greater than the first yield strength (yield strength before aging) and the second yield strength of the aged aluminum alloy is at least 250 MPa. According to invention, as will be shown in below examples, it was discovered that the relative differences in strength or hardness observed right after the ECAE step between various ECAE process conditions persist even after optimal aging heat treatment (i.e. peak aging). Those various ECAE process conditions that influence peak strength include in particular the number of passes, the loading path of billet, the temperature during isothermal processing and the temperatures of die and billet during non-isothermal processing. This means that the variations in microstructural features such as dislocations or subgrains (as described in previous sections) that are created by ECAE continue to be important during aging because ECAE microstructures influence precipitation and resulting peak strength.

It may be advantageous to perform multiple ECAE passes. For example, in some embodiments, two or more passes may be used during an ECAE process. In some embodiments, three or more, or four or more passes may be used. In some embodiments, a high number of ECAE passes provides a more uniform and refined microstructure with more equiaxed high angle boundaries and dislocations that result in superior strength and ductility of the extruded material.

In some embodiments, additional thermo-mechanical processes such as rolling and/or forging may be used after the aluminum alloy has undergone ECAE and either before or after aging heat treatment to get the aluminum alloy closer to the final billet shape before machining the aluminum alloy into its final production shape. In some embodiments, the additional rolling or forging steps can add further strength by introducing more dislocations in the microstructure of the alloy material.

Hardness was primarily used to evaluate the strength of material as shown in examples below. The hardness of a material is its resistance to surface indentation under standard test conditions. It is a measure of the material's resistance to localized plastic deformation. Pressing a hardness indenter into the material involves plastic deformation (movement) of the material at the location where the indenter is impressed. The plastic deformation of the material is a result of the amount of force applied to the indenter exceeding the strength of the material being tested. Therefore, the less the material is plastically deformed under the hardness test indenter, the higher the strength of the material. At the same time, less plastic deformation results in a shallower hardness impression; thereby resulting in a higher hardness number. This provides an overall relationship, where the higher a material's hardness, the higher the expected strength. That is, both hardness and yield strength are indicators of a metal's resistance to plastic deformation. Consequently, they are roughly proportional. The Brinell hardness test method as used to determine Brinell hardness is defined according to ASTM Eli) and is useful to test materials that have a structure that is too coarse or that have a surface that is too rough to be tested using another test method, e.g., castings and forgings. For the examples included below, a Brinell hardness tester (available from Instron®, located in Norwood, MA) was used. The tester applies a predetermined load (500 kgf) to a carbide ball of fixed diameter (10 mm), which is held for a predetermined period of time (10-15 seconds) per procedure, as described in ASTM standard.

Tensile strength was also evaluated for process conditions of most interest (see examples and figures next). Tensile strength is usually characterized by two parameters: yield strength (YS) and ultimate tensile strength (UTS). Ultimate tensile strength is the maximum measured strength during a tensile test and it occurs at a well-defined point. Yield strength is the amount of stress at which plastic deformation becomes noticeable and significant under tensile testing. Because there is usually no definite point on an engineering stress-strain curve where elastic strain ends and plastic strain begins, the yield strength is chosen to be that strength where a definite amount of plastic strain has occurred. For general engineering structural design, the yield strength is chosen when 0.2% plastic strain has taken place. The 0.2% yield strength or the 0.2% offset yield strength is calculated at 0.2% offset from the original cross-sectional area of the sample. The equation that may be used is $s=P/A$, where s is the yield stress or yield strength, P is the load and A is the area over which the load is applied. Note that yield strength is more sensitive than ultimate tensile strength due to other microstructural factors such as grain and phase size and distribution.

EXAMPLES

The following non-limiting examples illustrate various features and characteristics of the present invention, which is not to be construed as limited thereto.

Example 1: Optimization of Isothermal ECAE Processing

Figure 9:
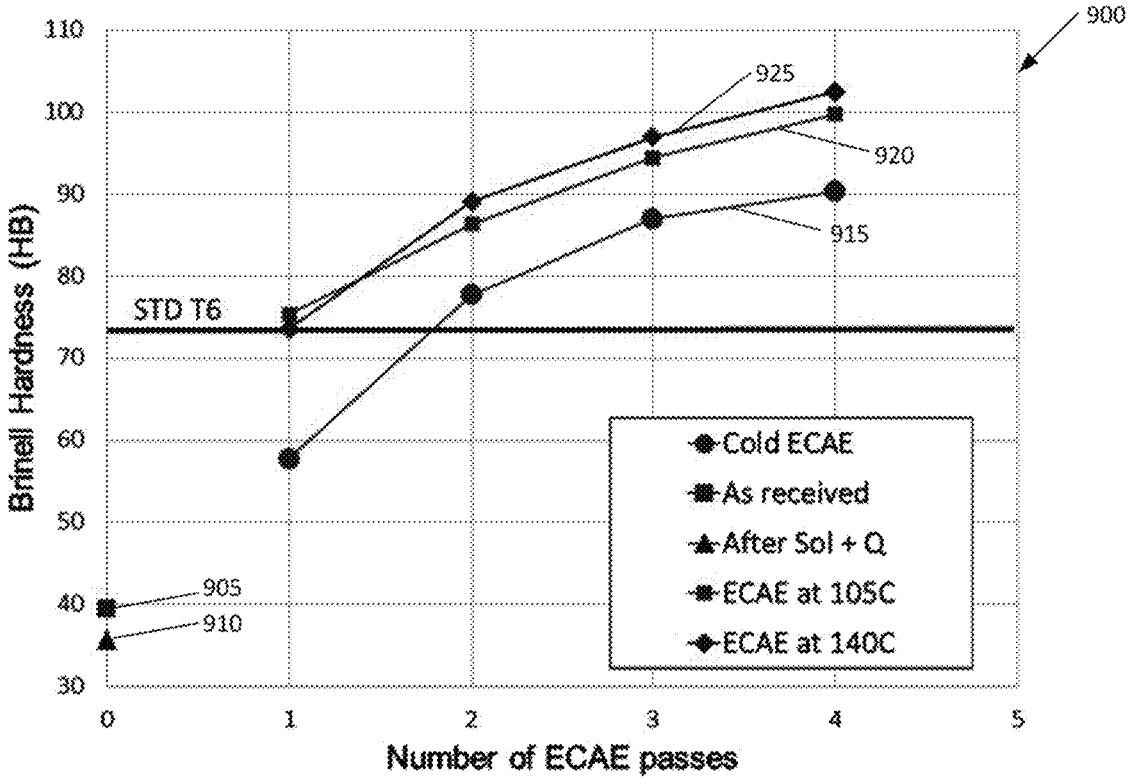
FIG. 9 is a graph illustrating the effect of isothermal process temperature on hardness (no aging heat treatment).

FIG. 9 illustrates the effect of isothermal process temperature on hardness (without aging). Samples having been ECAE processed with a number of passes from 1 to 4 were then tested for BH. Data representing varying processing parameters are shown in FIG. 9. FIG. 9 illustrates plot 900 having data point 905 for the hardness of the initial or 'as received' material and data point 910 represents the hardnesss for the material after solutionizing at 530° C. and quenching. Samples were tested for BH as a function of 1, 2, 3, and 4 ECAE passes: plot 915 undergoing ECAE processing under cold conditions, plot 920 undergoing ECAE processing under isothermal conditions at 105° C., and plot 925 undergoing ECAE processing under isothermal conditions at 140° C. An increase in hardness as a function of number of passes was observed for increasing die & billet temperature from room temperature (cold) to isothermal conditions at 105° C. to isothermal conditions at 140° C. Without being bound by theory, it is believed that dynamic precipitation before and during ECAE that promotes the creation of a higher number of dislocations and subgrains is more likely at higher temperatures and with more passes as depicted in schematics in FIG. 7.

Figure 10:
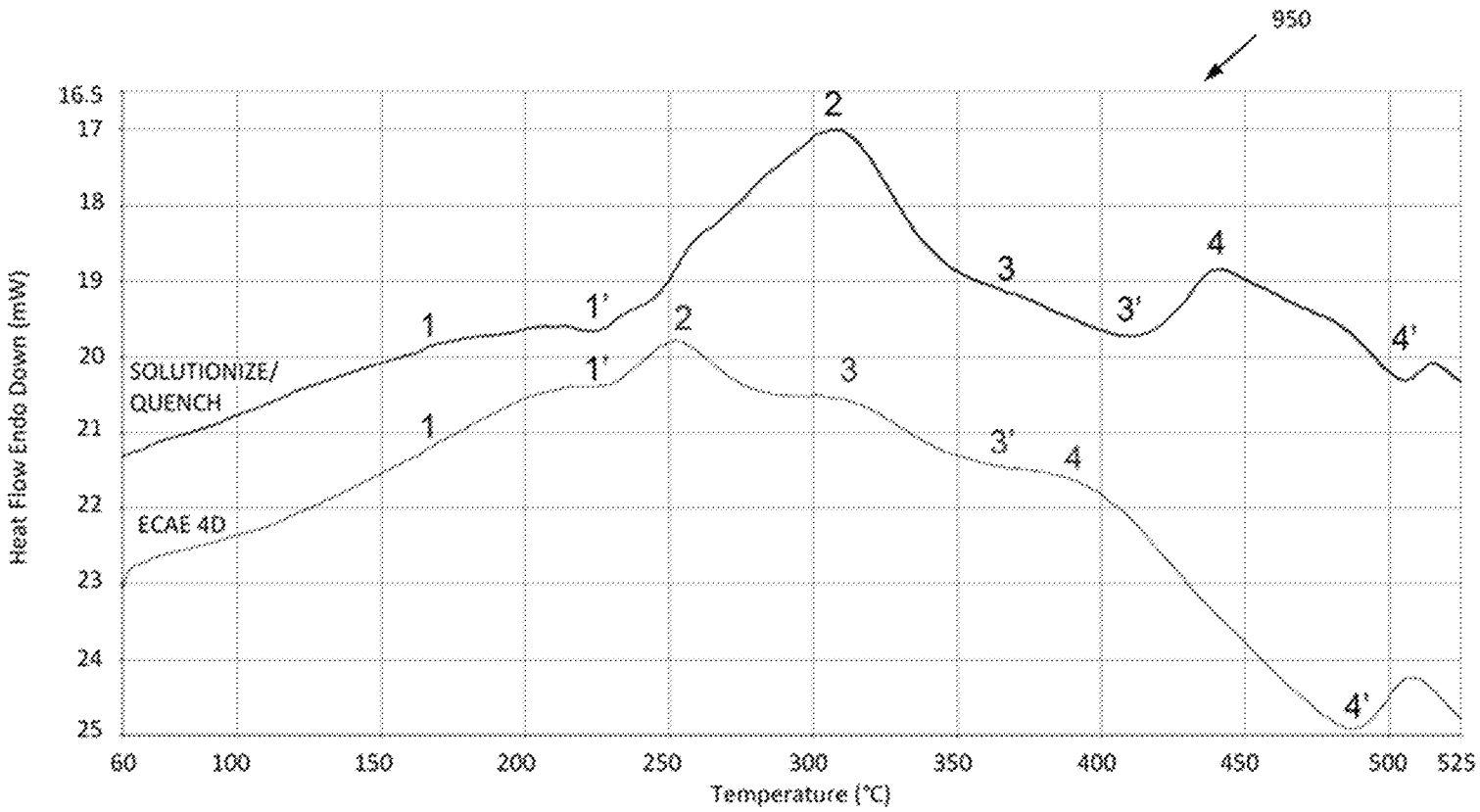
FIG. 10 is a Differential Scanning calorimetry (DSC) graph illustrating the effect of ECAE structures on the kinetics of precipitation.

Example 2: Kinetics of Precipitation in ECAE Materials as Demonstrated by Differential Scanning Calorimetry (DSC) Measurements The thermal behavior of solutionized+quenched Al 6063 samples before and after ECAE was evaluated by using a Perkin Elmer DSC8000 Differential Scanning calorimeter (DSC), the results of which are shown in FIG. 10. DSC is a technique that measures heat flows associated with specific transitions in materials as a function of temperature and time in a controlled atmosphere. Typical transitions in metals and alloys include formation and re-dissolution of precipitates. DSC was used to identify the precipitation events. Precipitation events are typically exothermic (system releases heat) and are shown as exothermic peaks in DSC, whereas dissolution events are endothermic (system receives heat). The DSC run was carried under pure nitrogen atmosphere at heating rate of 20° C./min. Al 6063 samples of about 35-40 mg were placed inside one of the pure aluminum pans in DSC chamber and the other pan was empty and used for reference. All samples were solutionized at a temperature of 530° C. for a few hours and rapidly quenched. The ECAE samples were isothermally processed at 105° C. for 4 passes. As shown in FIG. 10, plot 950 illustrates the complex sequence of precipitation in magnesium and silicon containing Al 6063. Peak 1 (exothermic) is associated with the formation of Guinier Preston (GP) zones followed by its dissolution (endothermic peak 1'), exothermic peaks 2, 3 and 4 (exothermic) correspond to the precipitation of coherent β", semi coherent β' and equilibrium incoherent β precipitates respectively, and endothermic peaks 2', 3' and 4' to the disappearance of β", β' and β respectively. Most peaks were detected except for peak 2' due to the concomitant dissolution of β" and formation of β'. Moreover, it was discovered that there is a shift of peak 2, 3, 3' and 4 toward lower temperatures for the ECAE processed Al 6063. This confirms that the dynamics of precipitation and redissolution is faster in ECAE processed materials due to the influence of various microstructural features such as submicron grains/subgrains and dislocations. This also means that it is necessary to optimize aging treatment in ECAE processed materials. Such optimization procedure for aging of ECAE Al 6063 is shown in the next example.

Example 3: Optimization of Aging Heat Treatment for ECAE Materials

Figure 11:
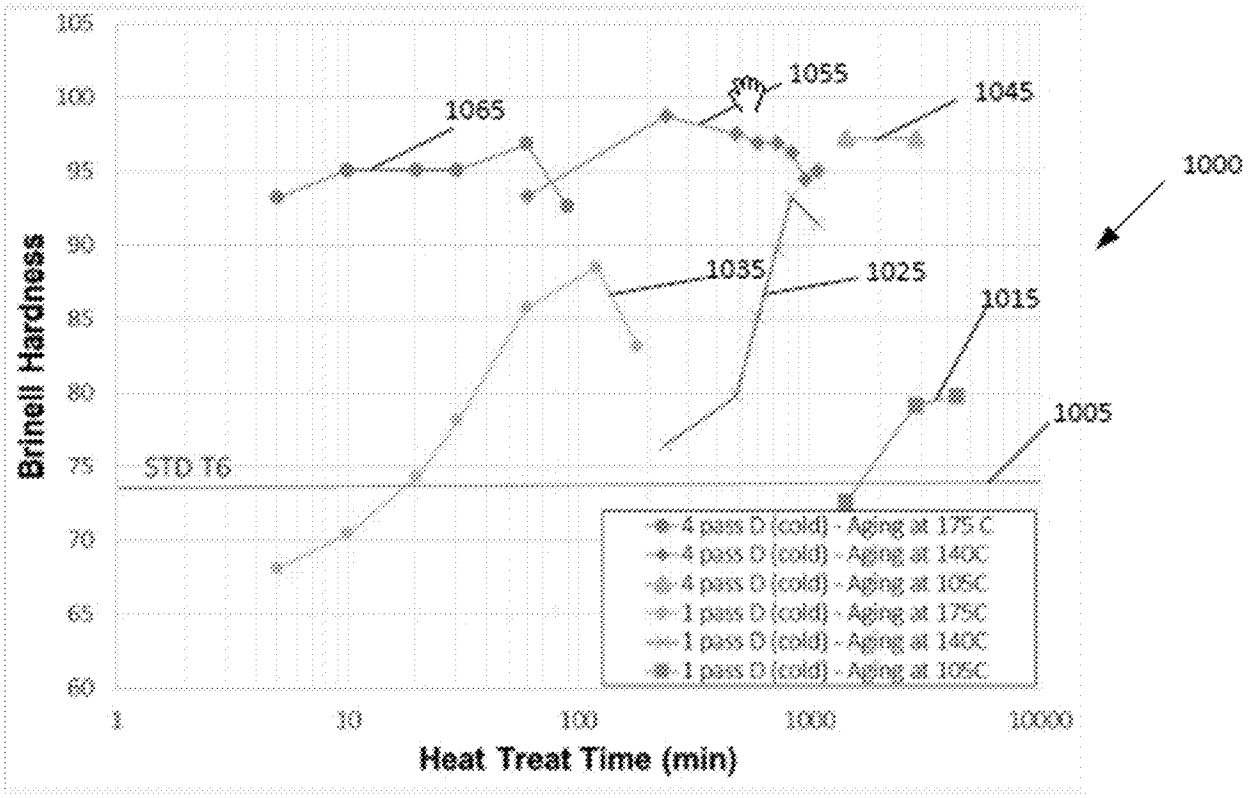
FIG. 11 is a graph illustrating optimized aging heat treatment conditions by comparing aging time at aging temperatures of 105° C., 140° C., and 175° C. to Brinell hardness in an aluminum alloy in accordance with the present disclosure.

FIG. 11 is illustrative of aging heat treatment temperature optimization. According to the optimization procedure, various aging temperatures and time are tried and for each ECAE process, then Brinell hardness is measured to evaluate the maximum hardness, which indicates optimal aging (also termed 'peak aging'). It was discovered through aging heat treatment optimization that higher peak strength is obtained at reduced temperatures and reduced times compared to that of a standard material. As shown in plot 1065, after 4 ECAE passes, only one hour at 175° C. is required to attain the highest BH as compared with 8 hours of aging at that temperature for standard Al 6063 T6 alloy (per ASM standard data). Additionally, it was found that aging temperatures substantially lower than 175° C. give higher peak strength in ECAE processed materials. For example, as shown by plot 1055, aging at 140° C. for 2 to 4 hours shows optimum aging temperature for the sample isothermally processed at room temperature and having 4 ECAE passes. The peak hardness for aging at 140° C. is around 98 HB as shown in plot 1055 and is higher than the peak hardness of 94 HB found after aging at 175° C. as shown in plot 1065. As was found, an aging temperature of about 140° C. represents the best compromise of temperature and time for aging. As shown for example in plot 1045, aging at 105° C. also provides high peak strength (higher than at 175° C.) but requires aging time well over 10 hours, which is undesirable for manufacturability. It was further discovered that several ECAE process conditions significantly influence peak strength and optimal peak aging treatment. The number of ECAE passes is illustrated in FIG. 11 for 1 pass versus 4 passes at different aging temperatures. As shown by plot 1065, after 4 ECAE passes, and plot 1035, after 1 ECAE pass, it takes less time to reach peak aging at an aging temperature of 175° C. for 4 passes compared to 1 pass, namely 1 hour for 4 passes versus 2 hours for 1 pass. Also, the maximum achievable peak hardness is less for 1 pass (88 BHN) versus 4 passes (94 BHN). It was discovered surprisingly that besides the number of passes and loading path, other ECAE processing parameters have a significant influence on peak strength and optimal aging treatment as will be described in the next examples: those include the temperature for isothermal ECAE process (Example 4) and the temperature of die and billet during non-isothermal processing (Example 5). Example 6 shows also the effect of pre-ECAE solutionizing temperature.

Example 4. Isothermal ECAE Processing After Peak Aging

Figure 12:
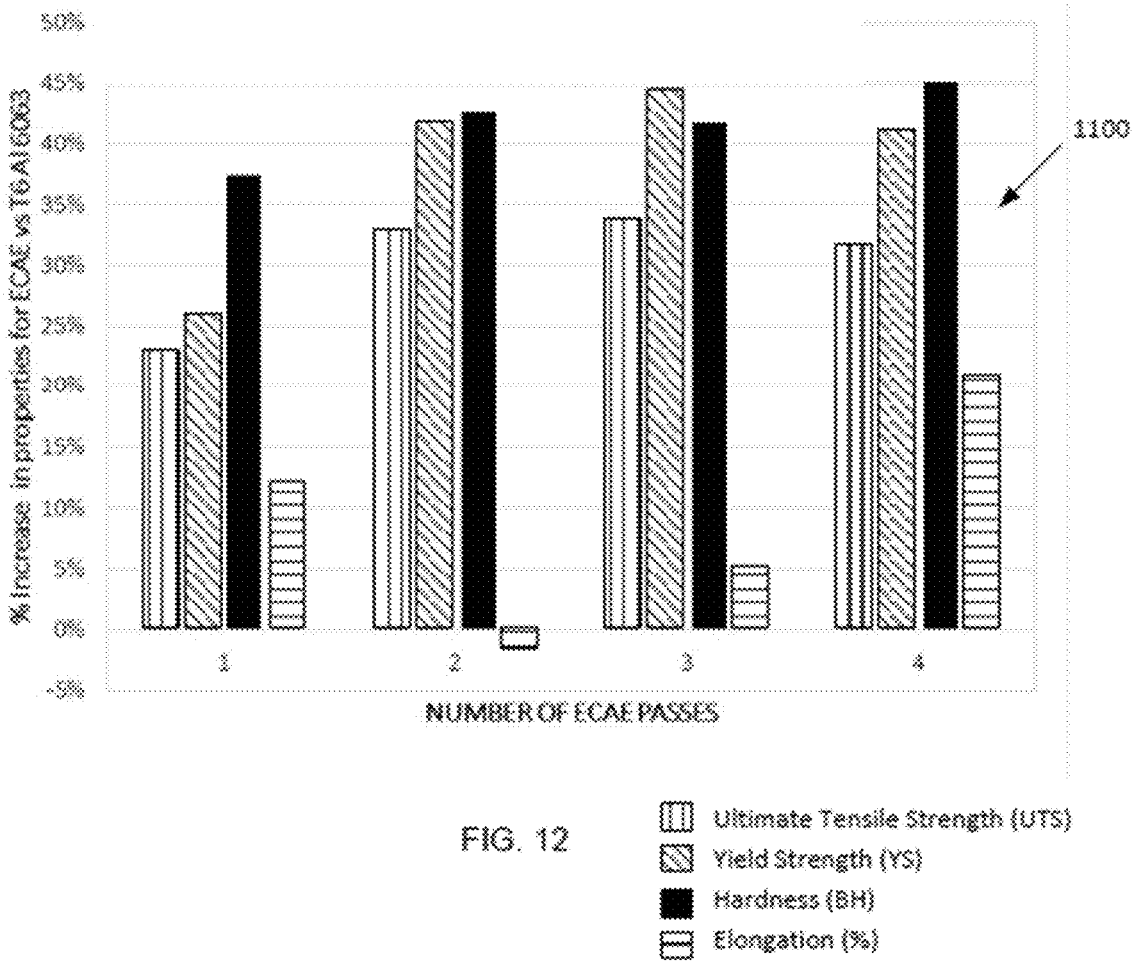
FIG. 12 is a graph illustrating the effect of isothermal processing plus peak aging heat treatment at 140° C. (shown as an increase in percentage as compared with standard T6) for an aluminum alloy processed in accordance with the present disclosure.

The effect of isothermal ECAE processing (at various number of ECAE passes) followed by optimized aging at 140° C. is shown as compared to Al 6063 T6 alloy material in FIG. 12. FIG. 12 is a graphical representation 1100 for data including UTS, YS, BH, and elongation percentage for samples solutionized at 530° C., isothermally ECAE processed, and aged at 140° C. The data is graphed as percentage increase in properties as compared with standard T6. For reference, the mechanical properties for standard Al 6063 T6 temper are UTS=245 MPa, YS=219 MPa, Brinell hardness=73 BHN and percentage elongation is 15.2%. For each data set for 1, 2, 3, and 4 ECAE passes, and from columns left to right, UTS, YS, BH, and percentage elongation are shown. Notably, the graph illustrates processing at 1, 2, 3, and 4 ECAE passes according to the optimized conditions above all show at least a 20% increase in UTS, at least a 25% increase in YS, at least a 35% increase in BH, and no significant decrease in elongation percentage as compared with standard T6 aluminum material.

Example 5: Isothermal Vs Non-Isothermal ECAE After Peak Aging

Figure 13:
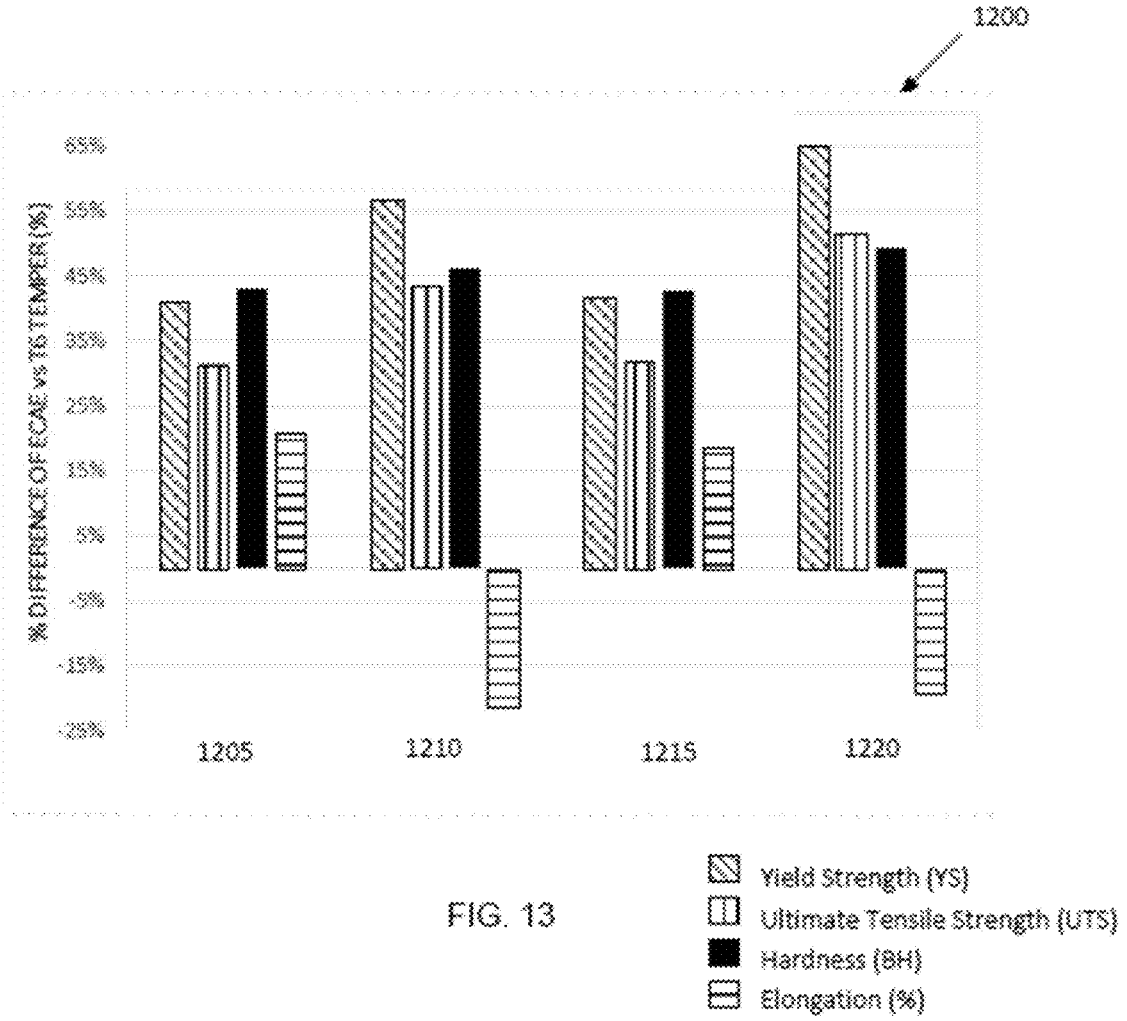
FIG. 13 is a graph comparing the ECAE processing, isothermally at 105° C. 1205, non-isothermally with billet at 105° C. 1210, isothermally at 140° C. 1215, and non-isothermally with billet at 140° C. 1220, to the resulting mechanical properties (shown as an increase in percentage as compared with standard T6) for an aluminum alloy processed in accordance with the present disclosure.

FIG. 13 is a graphical representation 1200 of data for varying ECAE processing parameters to compare non-isothermal versus isothermal processing conditions followed by optimized aging at 140° C. For each data set for ECAE conditions, and from columns left to right, YS, UTS, BH, and elongation are shown as percentage increase in properties as compared with standard T6. For reference, the mechanical properties for standard Al 6063 T6 temper are UTS=245 MPa, YS=219 MPa, Brinell hardness=73 HB and percentage elongation is 15.2%. The conditions for ECAE processing include data set 1205 for 4 pass ECAE processing isothermally at 105° C., data set 1210 for non-isothermal 4 pass ECAE conditions using a cold (room temperature) die and billet at 105° C., data set 1215 for 4 pass ECAE processing isothermally at 140° C., and data set 1220 for non-isothermal 4 pass ECAE conditions using a cold (room temperature) die and billet at 140° C. As FIG. 13 shows, non-isothermal conditions (cold die/heated billet) provides even higher increase in strength versus the standard T6 condition compared to isothermal conditions (billet and die temperature are the same) but with a decrease in elongation.

Example 6: Effect of (Pre-ECAE) Higher Solutionizing Temperature

Figure 14:
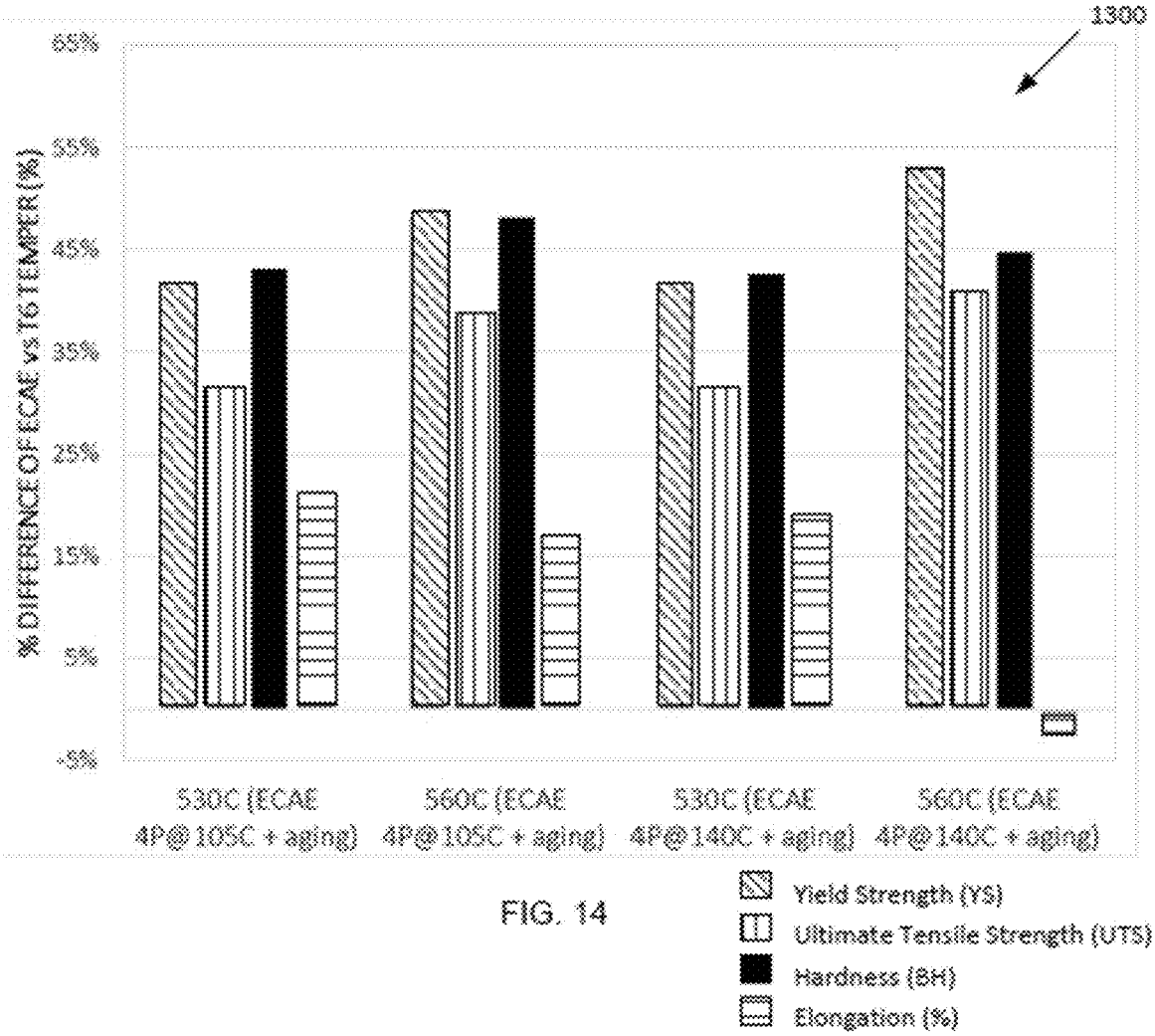
FIG. 14 is a graph illustrating the effect of increasing solutionizing temperature from 530° C. to 560° C.

FIG. 14 is a graph illustrating the effect of increasing solutionizing temperature from 530° C. to 560° C. for two exemplary temperatures of isothermal ECAE processing: 105° C. and 140° C. All samples were otherwise processed via 4 ECAE passes (isothermally) followed by peak aging. As is shown, for each chosen temperature of isothermal ECAE process (either 105° C. or 140° C.), the strength properties (YS, UTS, and BH) are generally improved for the higher solutionizing temperature (560° C. as compared to 530° C.) and followed by the higher aging temperature (140° C. as compared to 105° C.) without greatly affecting elongation.

Example 7: Sample Data was Collected and Compared with Standard T6 Data

As shown in Table 1, samples were tested for UTS, YS, BH, and elongation, and data are displayed in two ways: as measured and as percentage increase as with standard T6 data. The solutionizing temperature was 560° C. and the samples were ECAE processed isothermally for 1 to 4 passes at 105° C. or 140° C. Table shows results for Samples 0-7. Sample 0 represents standard Al 6063 T6 data. Samples 1 through 4 represent Al 6063 solutionized at 560° C. and ECAE processed isothermally for 1 pass (Sample 1), 2 passes (Sample 2), 3 passes (Sample 3), and 4 passes (Sample 4) at 105° C. Samples 5 through 7 represent Al 6063 solutionized at 560° C. and ECAE processed isothermally for 1 pass (Sample 5), 2 passes (Sample 6), and 4 passes (Sample 7) at 140° C.

TABLE 1

Table 1.

| Sample Process | # Passes | UTS (MPa) | YS (MPa) | Brinell Hardness | Elongation (%) | % increase in UTS vs T6 | % increase in YS vs T6 | % increase Brinell Hardness vs T6 | % increase in Elongation vs T6 |
|---|---|---|---|---|---|---|---|---|---|
| 0 | 0 | 245.0 | 219 | 73 | 15.2 | | N/A | | |
| 1 | 1 | 297.50 | 269.1 | 100.13 | 17.45 | 21% | 22.9% | 37% | 14.8% |
| 2 | 2 | 324.3 | 307.71 | 105.66 | 16.875 | 32% | 41% | 45% | 11.0% |
| 3 | 3 | 333 | 318.56 | 108.17 | 15.725 | 36% | 45% | 48% | 3.5% |
| 4 | 4 | 339.1 | 325.07 | 108.17 | 17.8 | 38% | 48% | 48% | 17.1% |
| 5 | 1 | 301.9 | 274.68 | 102.66 | 18 | 23% | 25% | 41% | 18.4% |
| 6 | 2 | 332.4 | 318.25 | 107.33 | 17.05 | 36% | 45% | 47% | 12.2% |
| 7 | 4 | 345.5 | 335.56 | 105.66 | 14.8 | 41% | 53% | 45% | −2.6% |

Example 8: Thermal Conductivity and Diffusivity Data

Thermal conductivity and diffusivity data were collected for Al 6061 and Al 6063 samples using ECAE processing and compared with standard (non ECAE) materials and shown in Table 2. All samples were solutionized at 530° C. for 3 hours and quenched. ECAE was performed isothermally for 4 passes followed by peak aging at 140° C.

TABLE 2

| Sample No. | Material/ Processing | Thick-ness (mm) | Thermal Conductivity (W/mK)) | Thermal Diffusivity ($mm^2/s$) |
|---|---|---|---|---|
| 8 | Al 6061 ECAE | 2.019 | 159.21 | 65.811 |
| 9 | Al 6061 ECAE | 2.001 | 154.503 | 63.865 |
| 10 | Al 6061 T6 | 2.002 | 157.593 | 65.143 |
| 11 | Al 6061 T6 | 1.86 | 153.779 | 63.566 |
| 12 | Al 6063 ECAE | 2.011 | 190.332 | 78.326 |
| 13 | Al 6063 ECAE | 2.017 | 193.506 | 79.632 |
| 14 | Al 6063 T6 | 2.044 | 187.331 | 77.091 |
| 15 | Al 6063 T6 | 2.034 | 185.567 | 76.365 |

A summary of thermal conductivity and diffusivity data is shown in Table 3 for Samples 8-15 of Table 2. Results indicate that ECAE Al alloys exhibit thermal properties similar if not slightly better than standard Al alloy with the T6 temper.

TABLE 3

| Material/ Processing | Mean Thermal Con-ductivity (W/mK)) | % difference ECAE vs T6 Mean Thermal Conductivity | Mean Thermal Diffusivity ($mm^2/s$) | % difference ECAE vs T6 Mean Thermal Diffusivity |
|---|---|---|---|---|
| Al 6061 ECAE | 156.9 | 0.75% | 64.8 | 0.75% |
| Al 6061 T6 | 155.7 | | 64.4 | |
| Al 6063 ECAE | 191.9 | 2.93% | 79.0 | 2.93% |
| Al 6063 T6 | 186.4 | | 76.7 | |

Various modifications and additions can be made to the exemplary embodiments discussed without departing from the scope of the present invention. For example, while the embodiments described above refer to particular features, the scope of this invention also includes embodiments having different combinations of features and embodiments that do not include all of the above described features.

What is claimed is:

1. A high strength aluminum alloy material comprising:

aluminum as a primary component and at least one of magnesium and silicon as a secondary component at a concentration of at least 0.2% by weight;

a Brinell hardness of at least 90 BHN;

a yield strength of at least 250 MPa;

an ultimate tensile strength of at least 275 MPa; and a percent elongation of at least 11.5%.

2. The high strength aluminum alloy material of claim 1, wherein the material contains at least 90% by weight aluminum.

3. The high strength aluminum alloy material of claim 2, wherein the material contains from about 0.3 wt. % to about 3.0 wt. % magnesium and from about 0.2 wt. % to about 2.0 wt. % silicon.

4. The high strength aluminum alloy material of claim 1, wherein the Brinell hardness is from about 95 BHN to about 160 BHN, the yield strength is from about 250 MPa to about 600 MPa, and the ultimate tensile strength is from about 275 MPa to about 600 MPa.

5. The high strength aluminum alloy material of claim 1, wherein the Brinell hardness is from about 100 BHN to about 160 BHN, the yield strength is from about 275 MPa to about 500 MPa, and the ultimate tensile strength is from about 300 MPa to about 500 MPa.

6. The high strength aluminum alloy material of claim 1, wherein the Brinell hardness is from about 110 BHN to about 160 BHN, the yield strength is from about 300 MPa to about 400 MPa, and the ultimate tensile strength is from about 310 MPa to about 400 MPa.

7. The high strength aluminum alloy of claim 1, wherein the aluminum alloy is an Al 6xxx series alloy.

8. The high strength aluminum alloy of claim 1, wherein the aluminum alloy is chosen from AA 6061 and AA6063.

9. The high strength aluminum alloy material of claim 1, the Brinell hardness of at least 95 BHN, the yield strength of at least 275 MPa, and the ultimate tensile strength of at least 300 MPa.

10. The high strength aluminum alloy material of claim 1, the Brinell hardness of at least 100 BHN, the yield strength of at least 300 MPa, the ultimate tensile strength of at least 310 MPa, and the percent elongation of at least 15%.

* * * * *